US007475646B2

(12) United States Patent
Widmer et al.

(10) Patent No.: US 7,475,646 B2
(45) Date of Patent: Jan. 13, 2009

(54) SYSTEM AND METHOD FOR DECREASING A RATE OF SLAG FORMATION AT PREDETERMINED LOCATIONS IN A BOILER SYSTEM

(75) Inventors: Neil Colin Widmer, San Clemente, CA (US); Avinash Vinayak Taware, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 427 days.

(21) Appl. No.: 11/290,759

(22) Filed: Nov. 30, 2005

(65) Prior Publication Data

US 2007/0119351 A1 May 31, 2007

(51) Int. Cl.
*F23N 5/00* (2006.01)
*F23B 7/00* (2006.01)

(52) U.S. Cl. ..... 110/343; 110/190; 110/188

(58) Field of Classification Search ..... 110/185, 110/186, 188, 190, 343
See application file for complete search history.

(56) References Cited

U.S. PATENT DOCUMENTS

| | | | | |
|---|---|---|---|---|
| 3,369,749 | A | 2/1968 | Siegmund et al. | |
| 4,488,516 | A | 12/1984 | Bueters et al. | |
| 4,517,902 | A * | 5/1985 | Christian | 110/190 |
| 4,887,958 | A | 12/1989 | Hagar et al. | |
| 4,927,351 | A | 5/1990 | Hagar et al. | |
| 4,996,951 | A | 3/1991 | Archer et al. | |
| 6,164,221 | A | 12/2000 | Facchiano et al. | |
| 6,361,310 | B1 * | 3/2002 | Fastnacht et al. | 431/12 |
| 6,729,248 | B2 * | 5/2004 | Johnson et al. | 110/342 |
| 6,745,708 | B2 * | 6/2004 | Slater et al. | 110/348 |
| 2004/0191914 | A1 | 9/2004 | Widmer | |

FOREIGN PATENT DOCUMENTS

| | | |
|---|---|---|
| EP | 1705462 | 9/2006 |
| GB | 2411007 | 8/2005 |
| WO | WO9939137 | 8/1999 |

OTHER PUBLICATIONS

European Search Report, Application No. EP06124971 dated Oct. 10, 2007.

European Search Report, Application No. EP6124970 dated Oct. 10, 2007.

(Continued)

*Primary Examiner*—Kenneth B Rinehart
(74) *Attorney, Agent, or Firm*—Cantor Colburn LLP

(57) ABSTRACT

A system and a method for decreasing a rate of slag formation at predetermined locations in a boiler system are provided. The boiler system has a plurality of burners, a plurality of slag detection sensors, a plurality of temperature sensors and a plurality of CO sensors disposed therein. The system determines locations within the boiler system that have relatively high slag thickness levels utilizing the plurality of slag detection sensors and then adjusts A/F ratios or mass flows of burners affecting those locations, or adds slag reducing additives to the burners affecting those locations, to decrease a rate of slag formation at the locations, utilizing signals from the plurality of slag detection sensor, the plurality of temperature sensors, and the plurality of CO sensors.

24 Claims, 12 Drawing Sheets

OTHER PUBLICATIONS

European Search Report, Application No. EP06125034, dated Oct. 10, 2007.

Contemporaneously filed US patent application for "System, Method, and Article of Manufacture for Adjusting Temperature Levels at Predetermined Locations in a Boiler System," U.S. Appl. No. 11/290,244, filed Nov. 30, 2005.

Contemporaneously filed US patent application for "System and Method and Article of Manufacture for Adjusting Co Emission Levels at Predetermined Locations in a Boiler System" U.S. Appl. No. 11/290,754, filed Nov. 30, 2005.

* cited by examiner

SYSTEM AND METHOD FOR DECREASING A RATE OF SLAG FORMATION AT PREDETERMINED LOCATIONS IN A BOILER SYSTEM

CROSS REFERENCE TO RELATED APPLICATIONS

This application is related to the following U.S. Patent Applications filed contemporaneously herewith: SYSTEM, METHOD, AND ARTICLE OF MANUFACTURE FOR ADJUSTING TEMPERATURE LEVELS AT PREDETERMINED LOCATIONS IN A BOILER SYSTEM, Ser. No. 11/290,244; and SYSTEM, METHOD, AND ARTICLE OF MANUFACTURE FOR ADJUSTING CO EMISSION LEVELS AT PREDETERMINED LOCATIONS IN A BOILER SYSTEM, Ser. No. 11/290,754 which are incorporated by reference herein in their entirety.

BACKGROUND OF THE INVENTION

Fossil-fuel fired boiler systems have been utilized for generating electricity. One type of fossil-fuel fired boiler system combusts an air/coal mixture to generate heat energy that increases a temperature of water to produce steam. The steam is utilized to drive a turbine generator that outputs electrical power.

A problem associated with the foregoing boiler system is that the boiler system can have spatial regions or locations where slag or unburnt hydrocarbons begin to adhere to walls of the boiler system. When slag formations become relatively thick, the slag formations can dislodge from the walls and damage equipment within the boiler system. This slag formation, if not timely controlled, thus affects the maintenance cycle of the boiler system by causing an early costly cleanup operation. This in turn adversely affects the power generation sales due to the resultant downtime. At the same time, these slag formations reduce the heat transfer coefficient (capability) at these locations in a superheat and reheat zone since it reduces the overall thermal efficiency of the boiler system, increasing an operational cost of the boiler system for power generation.

Accordingly, the inventors herein have recognized a need for a system and method for controlling a boiler system that can decrease a rate of slag formation at predetermined locations within the boiler system. At the same time, by implementing a burner level air mass flow and fuel mass flow control, this system and method will help in economizing the usage of costly slag reducing compounds or additives at the burner level by scheduling such usage only for burners that have a higher impact on slag formations at predetermined locations within the boiler system.

BRIEF DESCRIPTION OF THE INVENTION

A method for decreasing a rate of slag formation in predetermined locations within a boiler system in accordance with an exemplary embodiment is provided. The boiler system has a first plurality of burners, a plurality of slag detection sensors, a plurality of temperature sensors, and a plurality of CO sensors disposed therein. The method includes receiving a first plurality of signals from the plurality of temperature sensors disposed in the boiler system. The method further includes determining a plurality of temperature levels at a first plurality of locations in the boiler system based on the first plurality of signals. The method further includes receiving a second plurality of signals from the plurality of CO sensors disposed in the boiler system. The method further includes determining a plurality of CO levels at the first plurality of locations based on the second plurality of signals. The method further includes receiving a third plurality of signals from the plurality of slag detection sensors disposed in the boiler system. The method further includes determining a plurality of slag thickness levels at the first plurality of locations based on the third plurality of signals. The method further includes determining a second plurality of locations that have slag thickness levels greater than a threshold slag thickness level and temperature levels greater than a threshold temperature level and CO levels greater than a threshold CO level. The second plurality of locations are a subset of the first plurality of locations. The method further includes determining a second plurality of burners in the boiler system that are contributing to the second plurality of locations having slag thickness levels greater than the threshold slag thickness level and temperature levels greater than the threshold temperature level and CO levels greater than the threshold CO level. The second plurality of burners are a subset of the first plurality of burners. The method further includes increasing an A/F ratio of at least one burner of the second plurality of burners, to decrease the rate of slag formation at the second plurality of locations.

A control system for decreasing a rate of slag formation in predetermined locations within a boiler system in accordance with another exemplary embodiment is provided. The boiler system has a first plurality of burners. The control system includes a plurality of temperature sensors disposed in the boiler system. The plurality of temperature sensors are configured to generate a first plurality of signals indicative of temperature levels at a first plurality of locations in the boiler system. The control system further includes a plurality of CO sensors disposed in the boiler system. The plurality of CO sensors are configured to generate a second plurality of signals indicative of CO levels at the first plurality of locations in the boiler system. The control system further includes a plurality of slag detection sensors disposed in the boiler system. The plurality of slag detection sensors are configured to generate a third plurality of signals indicative of slag thicknesses at the first plurality of locations in the boiler system. The control system further includes a controller operably coupled to the plurality of temperature sensors and to the plurality of CO sensors and the plurality of slag detection sensors. The controller is configured to determine a plurality of temperature levels at the first plurality of locations based on the first plurality of signals. The controller is further configured to determine a plurality of CO levels at the first plurality of locations based on the second plurality of signals. The controller is further configured to determine a plurality of slag thickness levels at the first plurality of locations based on the third plurality of signals. The controller is further configured to determine a second plurality of locations that have slag thickness levels greater than a threshold slag thickness level and temperature levels greater than a threshold temperature level and CO levels greater than a threshold CO level. The second plurality of locations are a subset of the first plurality of locations. The controller is further configured to determine a second plurality of burners in the boiler system that are contributing to the second plurality of locations having slag thickness levels greater than the threshold slag thickness level and temperature levels greater than the threshold temperature level and CO levels greater than the threshold CO level. The second plurality of burners are a subset of the first plurality of burners. The controller is further configured to increase an A/F ratio of at least one burner of the second plurality of burners, to decrease the rate of slag formation at the second plurality of locations.

A method for decreasing a rate of slag formation in predetermined locations within a boiler system in accordance with another exemplary embodiment is provided. The boiler system has a first plurality of burners, a plurality of slag detection sensors, a plurality of temperature sensors, and a plurality of CO sensors disposed therein. The method includes receiving a first plurality of signals from the plurality of temperature sensors disposed in the boiler system. The method further includes determining a plurality of temperature levels at a first plurality of locations in the boiler system based on the first plurality of signals. The method further includes receiving a second plurality of signals from the plurality of CO sensors disposed in the boiler system. The method further includes determining a plurality of CO levels at the first plurality of locations based on the second plurality of signals. The method further includes receiving a third plurality of signals from the plurality of slag detection sensors disposed in the boiler system. The method further includes determining a plurality of slag thickness levels at the first plurality of locations based on the third plurality of signals. The method further includes determining a second plurality of locations that have slag thickness levels greater than a threshold slag thickness level and temperature levels greater than a threshold temperature level and CO levels less than or equal to a threshold CO level. The second plurality of locations are a subset of the first plurality of locations. The method further includes determining a second plurality of burners in the boiler system that are contributing to the second plurality of locations having slag thickness levels greater than the threshold slag thickness level and temperature levels greater than the threshold temperature level and CO levels less than or equal to the threshold CO level. The second plurality of burners are a subset of the first plurality of burners. The method further includes decreasing at least one of an A/F ratio of at least one burner of the second plurality of burners and an air-fuel mass flow to the at least one burner of the second plurality of burners, to decrease the rate of slag formation at the second plurality of locations.

A control system for decreasing a rate of slag formation in predetermined locations within a boiler system in accordance with another exemplary embodiment is provided. The boiler system has a first plurality of burners. The control system includes a plurality of temperature sensors disposed in the boiler system. The plurality of temperature sensors are configured to generate a first plurality of signals indicative of temperature levels at a first plurality of locations in the boiler system. The control system further includes a plurality of CO sensors disposed in the boiler system. The plurality of CO sensors are configured to generate a second plurality of signals indicative of CO levels at the first plurality of locations in the boiler system. The control system further includes a plurality of slag detection sensors disposed in the boiler system. The plurality of slag detection sensors are configured to generate a third plurality of signals indicative of slag thicknesses at the first plurality of locations in the boiler system. The control system further includes a controller operably coupled to the plurality of temperature sensors and to the plurality of CO sensors and the plurality of slag detection sensors. The controller is configured to determine a plurality of temperature levels at the first plurality of locations based on the first plurality of signals. The controller is further configured to determine a plurality of CO levels at the first plurality of locations based on the second plurality of signals. The controller is further configured to determine a plurality of slag thickness levels at the first plurality of locations based on the third plurality of signals. The controller is further configured to determine a second plurality of locations that have slag thickness levels greater than a threshold slag thickness level and temperature levels greater than a threshold temperature level and CO levels less than or equal to a threshold CO level. The second plurality of locations are a subset of the first plurality of locations. The controller is further configured to determine a second plurality of burners in the boiler system that are contributing to the second plurality of locations having slag thickness levels greater than the threshold slag thickness level and temperature levels greater than the threshold temperature level and CO levels less than or equal to the threshold CO level. The second plurality of burners are a subset of the first plurality of burners. The controller is further configured to decrease at least one of an A/F ratio of at least one burner of the second plurality of burners and an air-fuel mass flow to the at least one burner of the second plurality of burners, to decrease the rate of slag formation at the second plurality of locations.

A method for decreasing a rate of slag formation in predetermined locations within a boiler system in accordance with another exemplary embodiment is provided. The boiler system has a first plurality of burners, a plurality of slag detection sensors, a plurality of temperature sensors, and a plurality of CO sensors disposed therein. The method includes receiving a first plurality of signals from the plurality of temperature sensors disposed in the boiler system. The method further includes determining a plurality of temperature levels at a first plurality of locations in the boiler system based on the first plurality of signals. The method further includes receiving a second plurality of signals from the plurality of CO sensors disposed in the boiler system. The method further includes determining a plurality of CO levels at the first plurality of locations based on the second plurality of signals. The method further includes receiving a third plurality of signals from the plurality of slag detection sensors disposed in the boiler system. The method further includes determining a plurality of slag thickness levels at the first plurality of locations based on the third plurality of signals. The method further includes determining a second plurality of locations that have slag thickness levels greater than a threshold slag thickness level and temperature levels less than or equal to a threshold temperature level and CO levels greater than a threshold CO level. The second plurality of locations are a subset of the first plurality of locations. The method further includes determining a second plurality of burners in the boiler system that are contributing to the second plurality of locations having slag thickness levels greater than the threshold slag thickness level and temperature levels less than or equal to the threshold temperature level and CO levels greater than the threshold CO level. The second plurality of burners are a subset of the first plurality of burners. The method further includes increasing an A/F ratio of at least one burner of the second plurality of burners to decrease the rate of slag formation at the second plurality of locations.

A control system for decreasing a rate of slag formation in predetermined locations within a boiler system in accordance with another exemplary embodiment is provided. The boiler system has a first plurality of burners. The control system includes a plurality of temperature sensors disposed in the boiler system. The plurality of temperature sensors are configured to generate a first plurality of signals indicative of temperature levels at a first plurality of locations in the boiler system. The control system further includes a plurality of CO sensors disposed in the boiler system. The plurality of CO sensors are configured to generate a second plurality of signals indicative of CO levels at the first plurality of locations in the boiler system. The control system further includes a plurality of slag detection sensors disposed in the boiler system. The plurality of slag detection sensors are configured to generate a third plurality of signals indicative of slag thicknesses at the first plurality of locations in the boiler system. The control system further includes a controller operably coupled to the plurality of temperature sensors and to the plurality of CO sensors and the plurality of slag detection sensors. The controller is configured to determine a plurality of temperature levels at the first plurality of locations based on the first plurality of signals. The controller is further configured to determine a plurality of CO levels at the first plurality of locations based on the second plurality of signals. The controller is further configured to determine a plurality of slag thickness levels at the first plurality of locations based on the third plurality of signals. The controller is further configured to determine a second plurality of locations that have slag thickness levels greater than a threshold slag thickness level and temperature levels less than or equal to a threshold temperature level and CO levels greater than a threshold CO level. The second plurality of locations are a subset of the first plurality of locations. The controller is further configured to determine a second plurality of burners in the boiler system that are contributing to the second plurality of locations having slag thickness levels greater than the threshold slag thickness level and temperature levels less than or equal to the threshold temperature level and CO levels greater than the threshold CO level. The second plurality of burners are a subset of the first plurality of burners. The controller is further configured to increase an A/F ratio of at least one burner of the second plurality of burners to decrease the rate of slag formation at the second plurality of locations.

A method for decreasing a rate of slag formation in predetermined locations within a boiler system in accordance with another exemplary embodiment is provided. The boiler system has a first plurality of burners, a plurality of slag detection sensors, a plurality of temperature sensors, and a plurality of CO sensors disposed therein. The method includes receiving a first plurality of signals from the plurality of temperature sensors disposed in the boiler system. The method further includes determining a plurality of temperature levels at a first plurality of locations in the boiler system based on the first plurality of signals. The method further includes receiving a second plurality of signals from the plurality of CO sensors disposed in the boiler system. The method further includes determining a plurality of CO levels at the first plurality of locations based on the second plurality of signals. The method further includes receiving a third plurality of signals from the plurality of slag detection sensors disposed in the boiler system. The method further includes determining a plurality of slag thickness levels at the first plurality of locations based on the third plurality of signals. The method further includes determining a second plurality of locations that have slag thickness levels greater than a threshold slag thickness level and temperature levels less than or equal to a threshold temperature level and CO levels less than or equal to a threshold CO level. The second plurality of locations are a subset of the first plurality of locations. The method further includes determining a second plurality of burners in the boiler system that are contributing to the second plurality of locations having slag thickness levels greater than the threshold slag thickness level and temperature levels less than or equal to the threshold temperature level and CO levels less than or equal to the threshold CO level. The second plurality of burners are a subset of the first plurality of burners. The method further includes decreasing at least one of an air-fuel mass flow to the least one burner of the second plurality of burners and a fuel mass flow to the at least one burner of the second plurality of burners, to decrease the rate of slag formation at the second plurality of locations.

A control system for decreasing a rate of slag formation in predetermined locations within a boiler system in accordance with another exemplary embodiment is provided. The boiler system has a first plurality of burners. The control system includes a plurality of temperature sensors disposed in the boiler system. The plurality of temperature sensors are configured to generate a first plurality of signals indicative of temperature levels at a first plurality of locations in the boiler system. The control system further includes a plurality of CO sensors disposed in the boiler system. The plurality of CO sensors are configured to generate a second plurality of signals indicative of CO levels at the first plurality of locations in the boiler system. The control system further includes a plurality of slag detection sensors disposed in the boiler system. The plurality of slag detection sensors are configured to generate a third plurality of signals indicative of slag thicknesses at the first plurality of locations in the boiler system. The control system further includes a controller operably coupled to the plurality of temperature sensors and to the plurality of CO sensors and the plurality of slag detection sensors. The controller is configured to determine a plurality of temperature levels at the first plurality of locations based on the first plurality of signals. The controller is further configured to determine a plurality of CO levels at the first plurality of locations based on the second plurality of signals. The controller is further configured to determine a plurality of slag thickness levels at the first plurality of locations based on the third plurality of signals. The controller is further configured to determine a second plurality of locations that have slag thickness levels greater than a threshold slag thickness level and temperature levels less than or equal to a threshold temperature level and CO levels less than or equal to a threshold CO level. The second plurality of locations are a subset of the first plurality of locations. The controller is further configured to determine a second plurality of burners in the boiler system that are contributing to the second plurality of locations having slag thickness levels greater than the threshold slag thickness level and temperature levels less than or equal to the threshold temperature level and CO levels less than or equal to the threshold CO level. The second plurality of burners are a subset of the first plurality of burners. The controller is further configured to decrease at least one of an air-fuel mass flow to the least one burner of the second plurality of burners and a fuel mass flow to the least one burner of the second plurality of burners, to decrease the rate of slag formation at the second plurality of locations.

A method for decreasing a rate of slag formation in predetermined locations within a boiler system in accordance with another exemplary embodiment is provided. The boiler system has a first plurality of burners and a plurality of slag detection sensors. The method includes receiving a first plurality of signals from the plurality of slag detection sensors disposed in the boiler system. The method further includes determining a plurality of slag thickness levels at a first plurality of locations in the boiler system based on the first plurality of signals. The method further includes determining a second plurality of locations in the boiler system that have slag thickness levels greater than a threshold slag thickness level. The second plurality of locations are a subset of the first plurality of locations. The method further includes determining a second plurality of burners in the boiler system that are contributing to the second plurality of locations having slag thickness levels greater than the threshold slag thickness level. The second plurality of burners are a subset of the first plurality of burners. The method further includes delivering a slag reducing compound to the second plurality of burners for decreasing the rate of slag formation at the second plurality of locations.

A control system for decreasing a rate of slag formation in predetermined locations within a boiler system in accordance with another exemplary embodiment is provided. The boiler system has a first plurality of burners. The control system includes a plurality of slag detection sensors disposed in the boiler system. The plurality of slag detection sensors are configured to generate a first plurality of signals indicative of slag thicknesses at a first plurality of locations in the boiler system. The control system further includes a controller operably coupled to the plurality of slag detection sensors. The controller is further configured to determine a plurality of slag thickness levels at the first plurality of locations based on the first plurality of signals. The controller is further configured to determine a second plurality of locations in the boiler system that have slag thickness levels greater than a threshold slag thickness level. The second plurality of locations are a subset of the first plurality of locations. The controller is further configured to determine a second plurality of burners in the boiler system that are contributing to the second plurality of locations having slag thickness levels greater than the threshold slag thickness level. The second plurality of burners are a subset of the first plurality of burners. The controller is further configured to induce a first device to deliver a slag reducing compound to the second plurality of burners for decreasing the rate of slag formation at the second plurality of locations.

Other systems and/or methods according to the embodiments will become or are apparent to one with skill in the art upon review of the following drawings and detailed description. It is intended that all such additional systems and methods be within the scope of the present invention, and be protected by the accompanying claims.

DETAILED DESCRIPTION OF THE INVENTION

Figure 1:
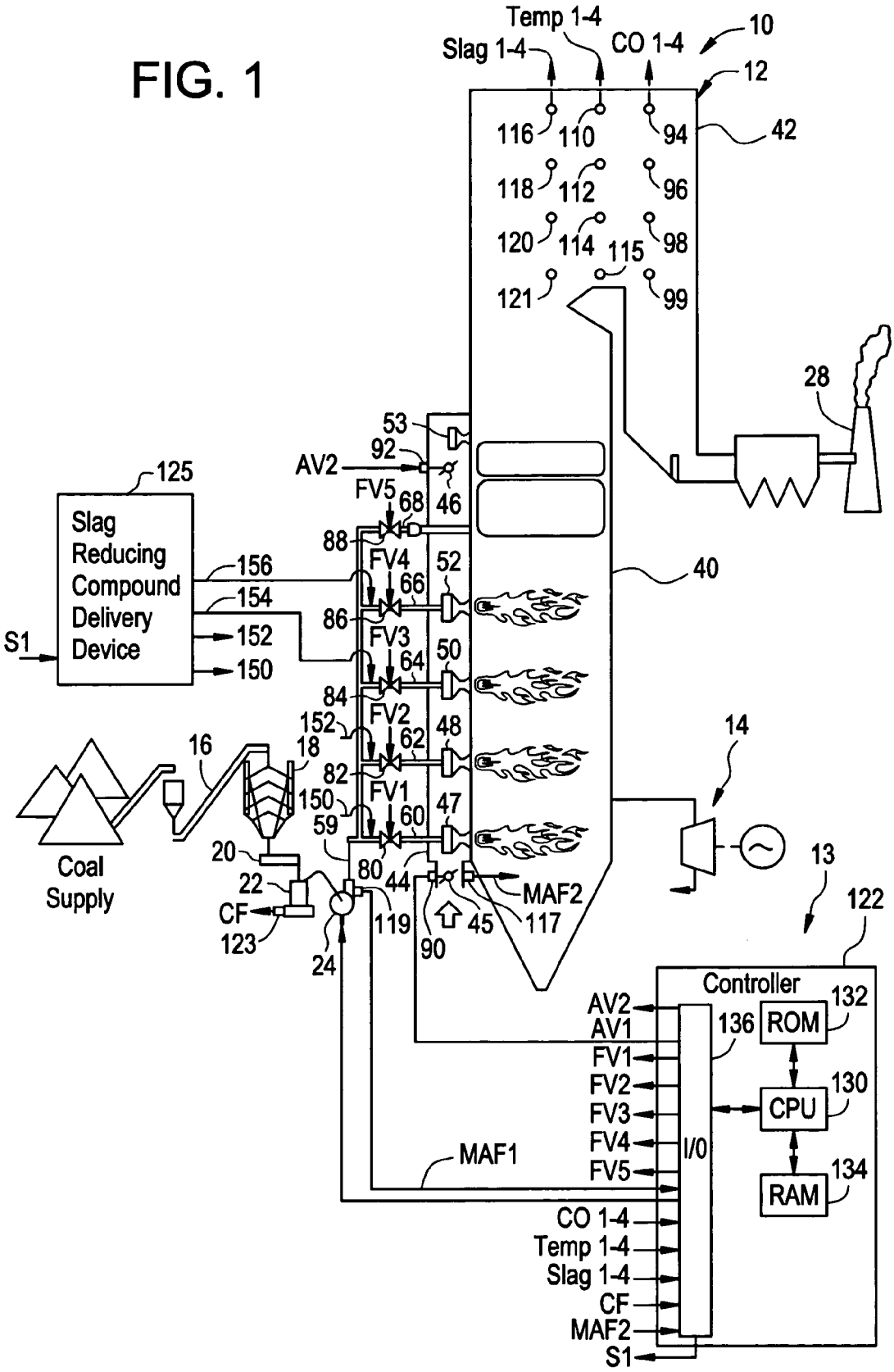
FIG. 1 illustrates a power generation system having a boiler system and a control system in accordance with an exemplary embodiment.

Referring to FIG. 1, a power generation system 10 for generating electrical power is illustrated. The power generation system 10 includes a boiler system 12, a control system 13, a turbine generator 14, a conveyor 16, a silo 18, a coal feeder 20, a coal pulverizer 22, an air source 24, and a smokestack 28.

The boiler system 12 is provided to burn an air-coal mixture to heat water to generate steam therefrom. The steam is utilized to drive the turbine generator 14, which generates electricity. It should be noted that in an alternative embodiment, the boiler system 12 could utilize other types of fuels, instead of coal, to heat water to generate steam therefrom. For example, the boiler system 12 could utilize any conventional type of hydrocarbon fuel such as gasoline, diesel fuel, oil, natural gas, propane, or the like. The boiler system 12 includes a furnace 40 coupled to a back path portion 42, an air intake manifold 44, burners 47, 48, 50, 52, an air port 53, and conduits 59, 60, 62, 64, 66, 68.

The furnace 40 defines a region where the air-coal mixture is burned and steam is generated. The back path portion 42 is coupled to the furnace 40 and receives exhaust gases from the furnace 40. The back pass portion 42 transfers the exhaust gases from the furnace 40 to the smokestack 28.

Figure 6:
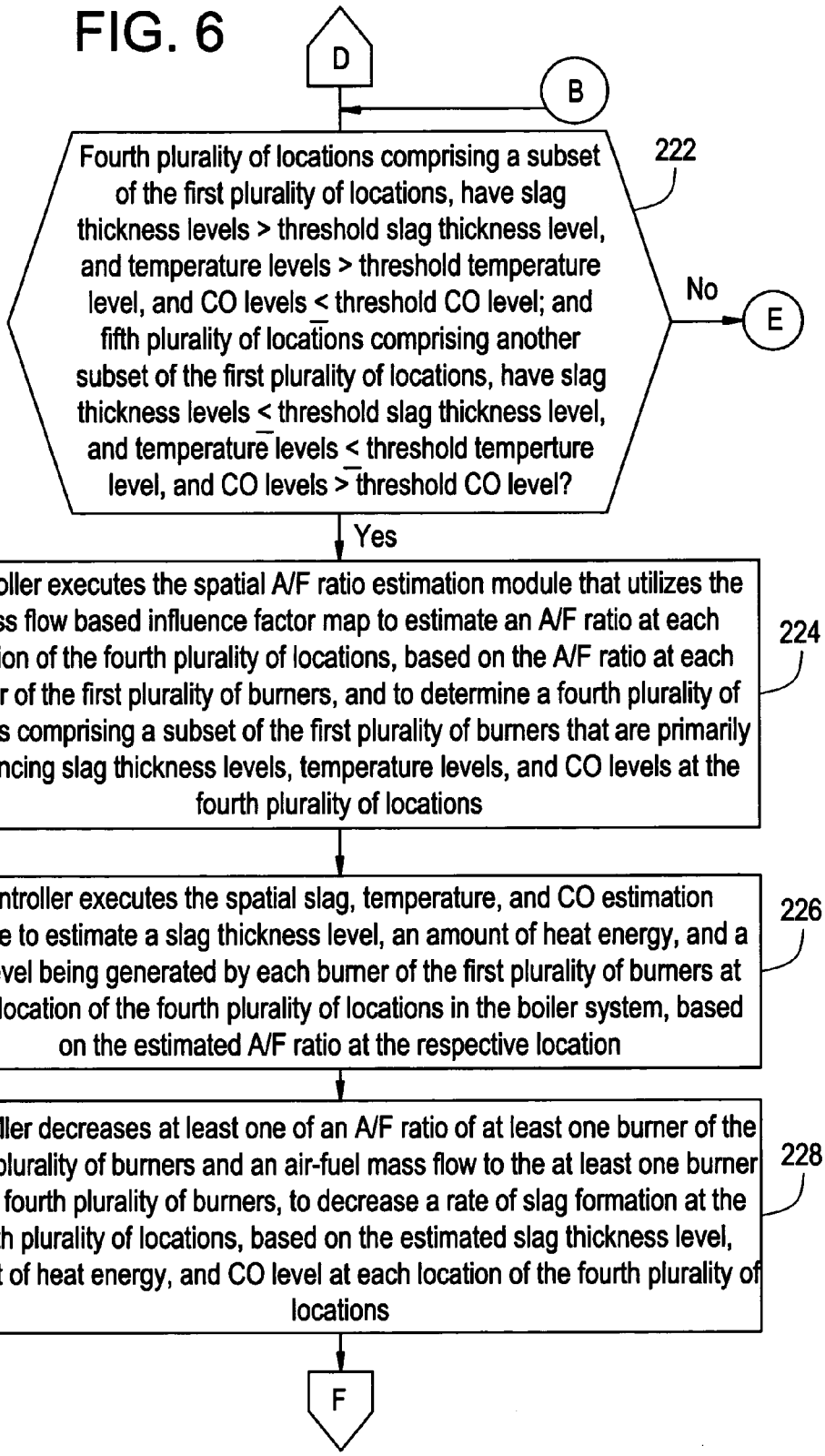
Figure 7:
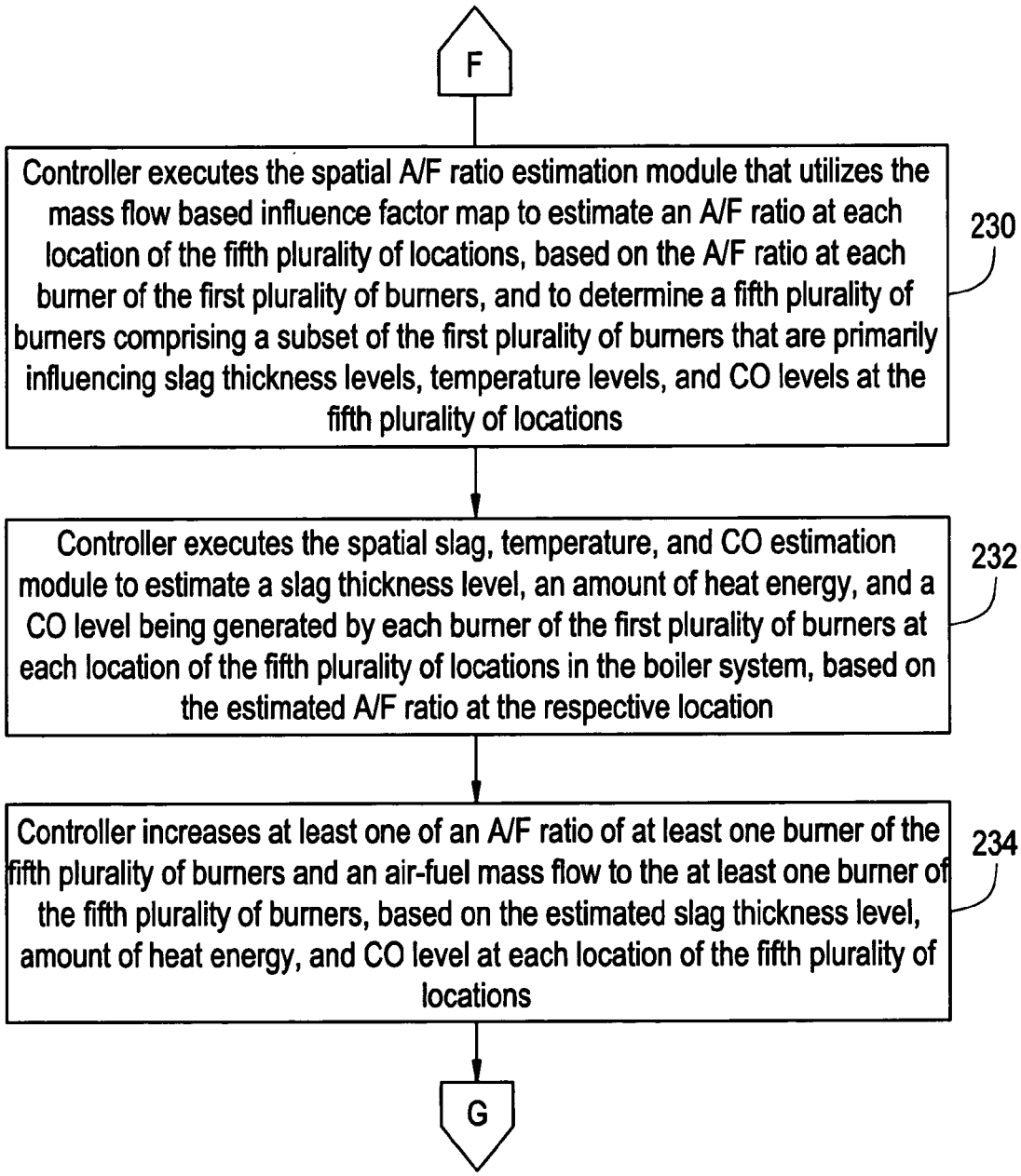
Figure 8:
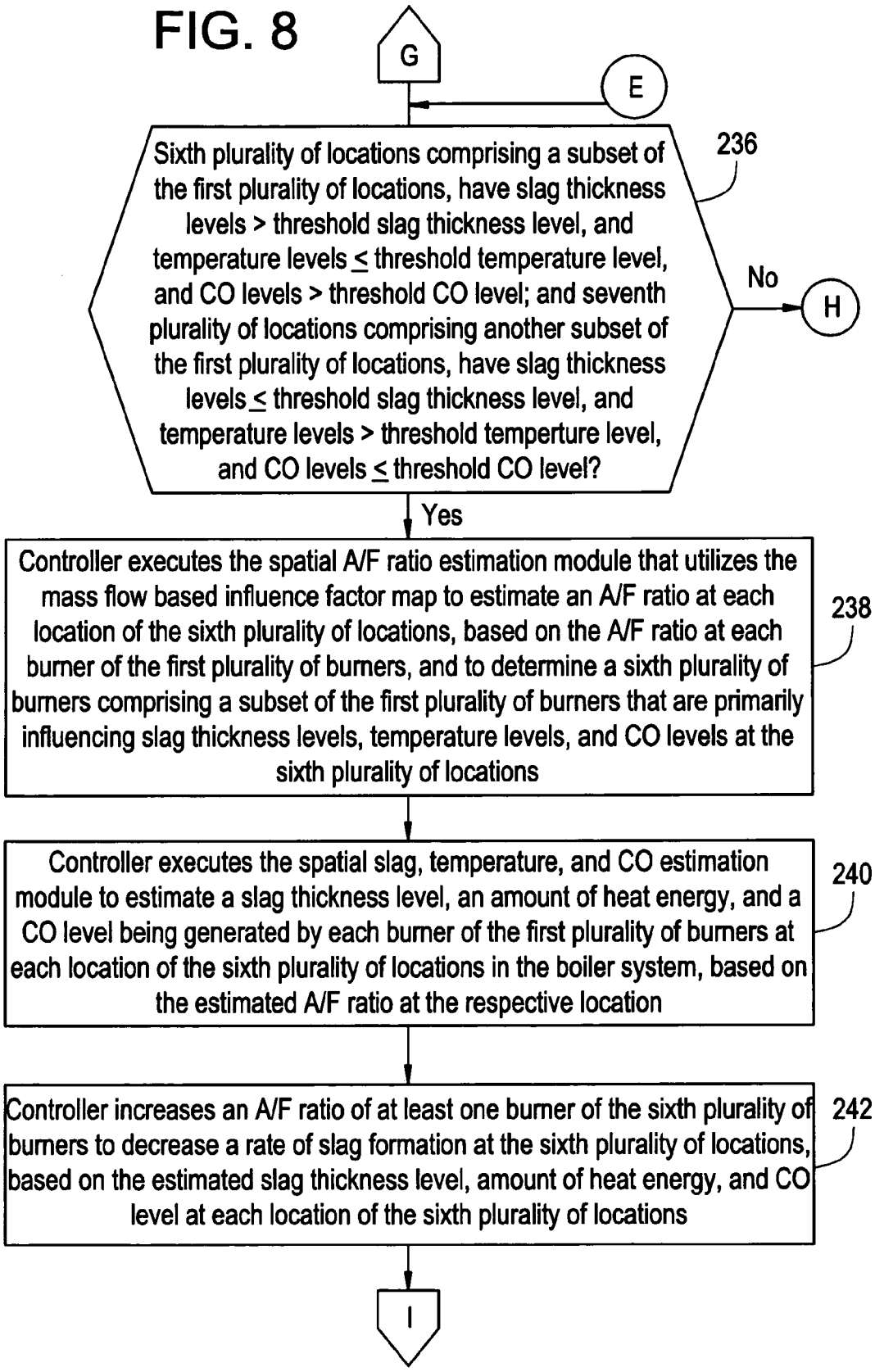
Figure 9:
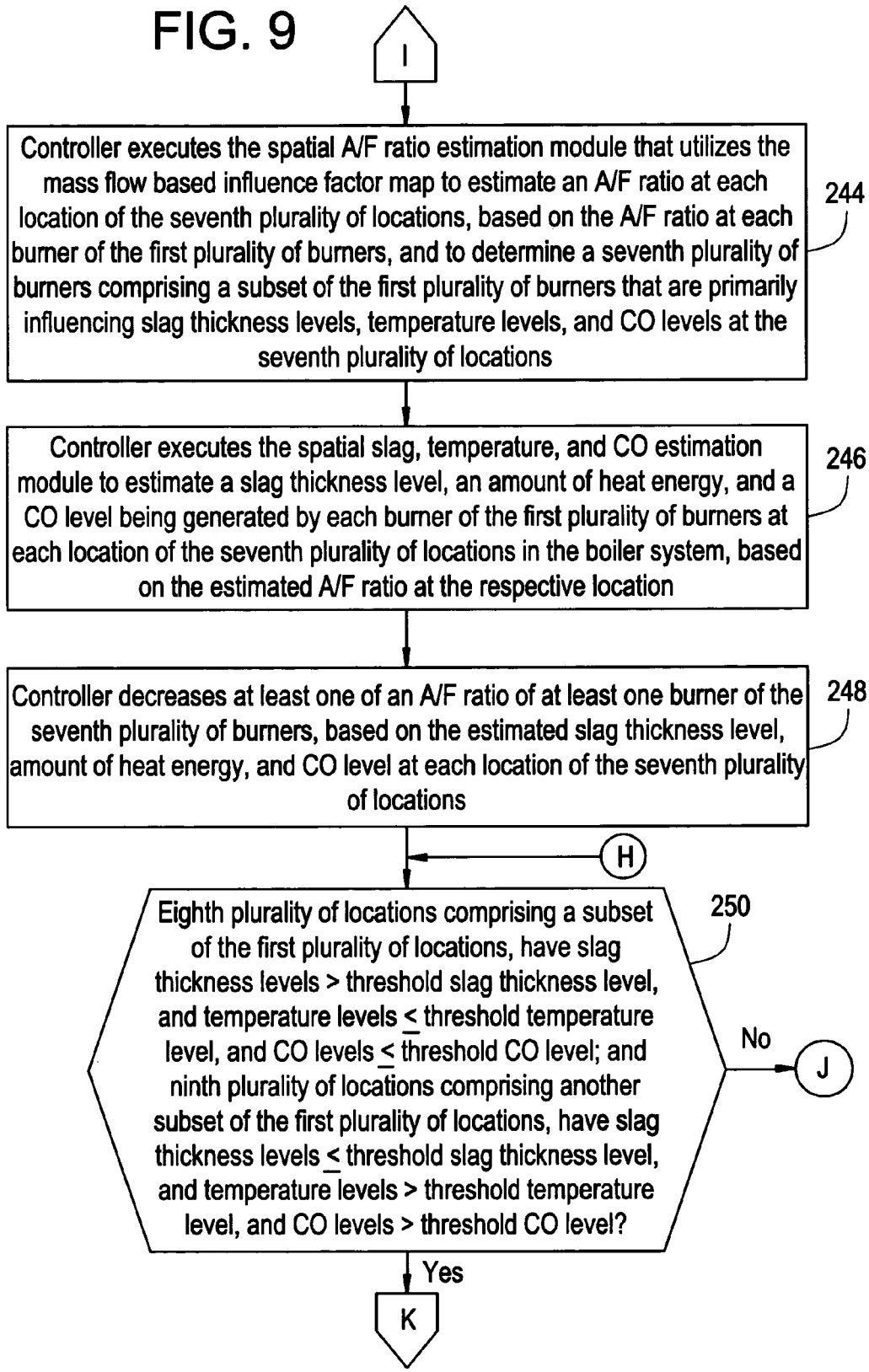
Figure 10:
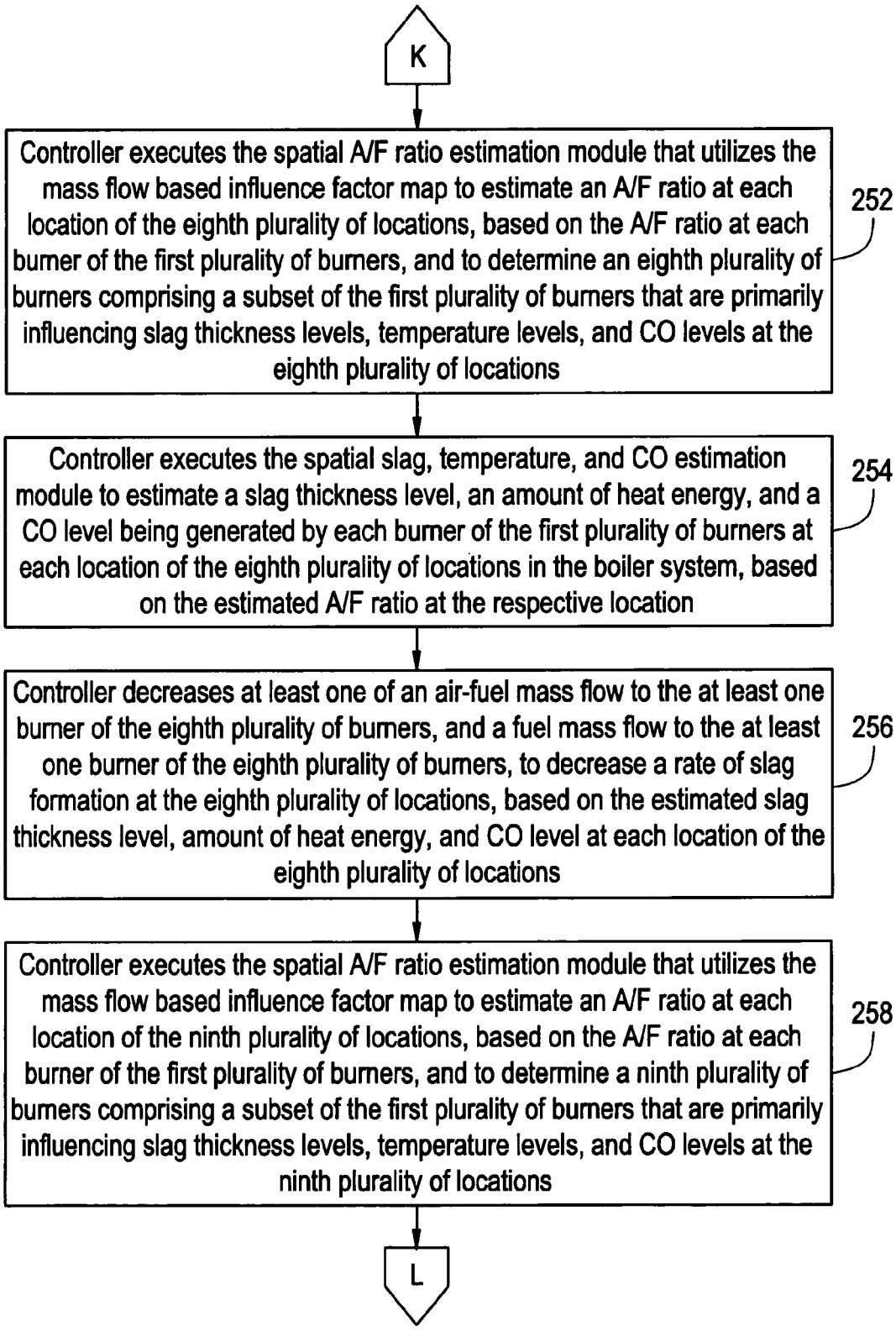
Figure 11:
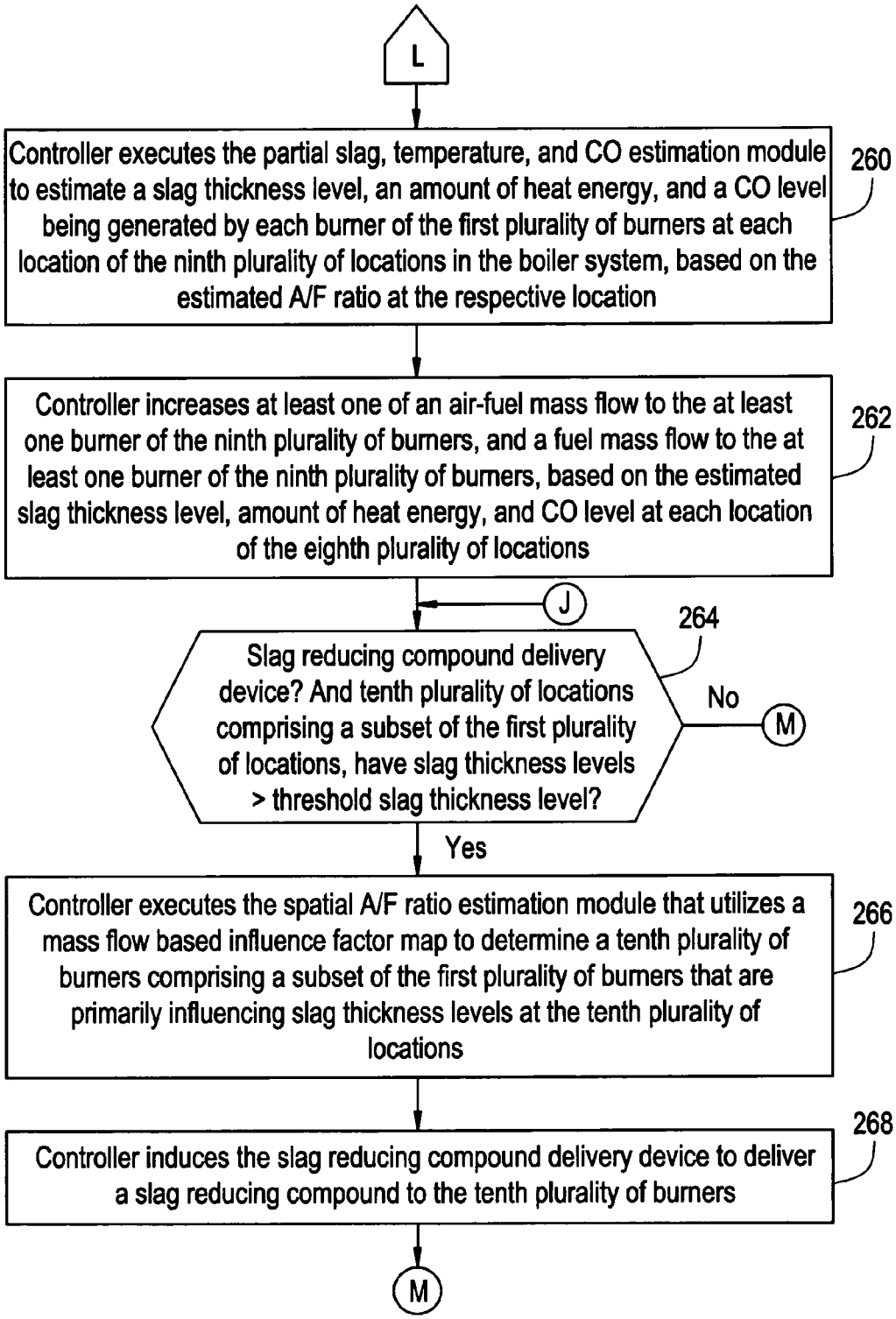
Figure 12:
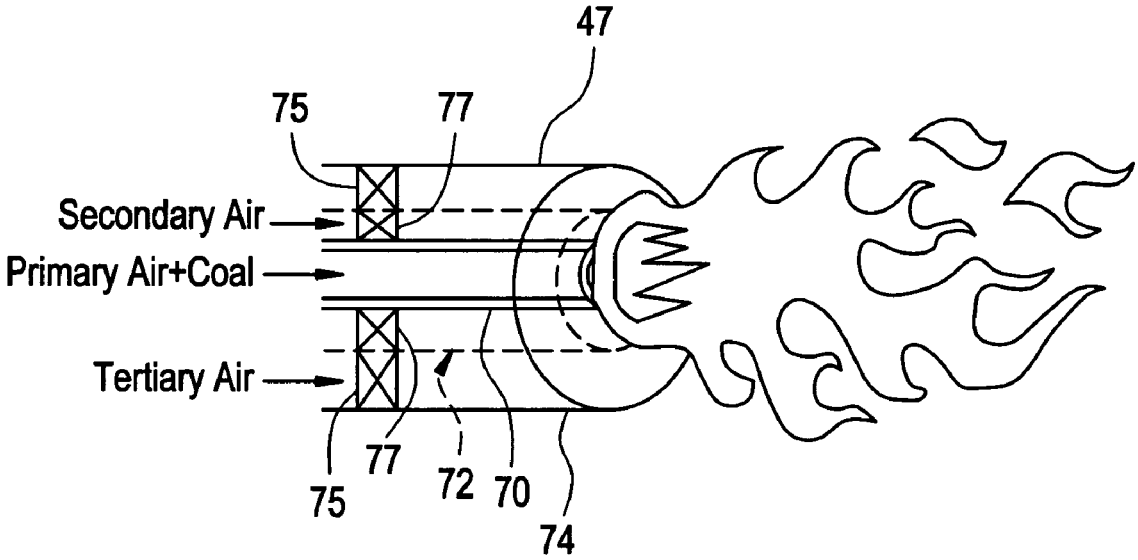
FIG. 12 is a schematic of a burner utilized in the boiler system of FIG. 1.

The air intake manifold 44 is coupled to the furnace 40 and provides a predetermined amount of secondary air to the burners 47, 48, 50, 52 and air port 53 utilizing the throttle valves 45, 46. Further, the burners 47, 48, 50, 52 receive an air-coal mixture from the air source 24 via the conduits 60, 62, 64, 66, respectively. The burners 47, 48, 50, 52 and air port 53 are disposed through apertures in the furnace 40. The burners 47, 48, 50, 52 emit flames into an interior region of the furnace 40 to heat water. Because the burners 47, 48, 50, 52 have a substantially similar structure, only a detailed explanation of the structure of the burner 47 will be provided. Referring to FIG. 6, the burner 47 has concentrically disposed tubes 70, 72, 74. The tube 70 receives the primary air-coal mixture (air-fuel mixture) from the conduit 60. The conduit 72 is disposed around the conduit 70 and receives secondary air from the air intake manifold 44. The conduit 74 is disposed around the conduit 72 and receives tertiary air also from the air intake manifold 44. The total air-coal mixture supplied to the burner 47 is ignited at an outlet port of the burner 47 and burned in the furnace. The burner 47 further includes a valve 75 disposed in the flow path between the tube 70 and the tube 72. An operational position of the valve 75 can be operably controlled by the controller 122 to control an amount of tertiary air being received by the burner 47. Further, the burner 47 further includes a valve 77 disposed in the flow path between the tube 72 and the tube 74. An operational position of the valve 77 can be operably controlled by the controller 122 to control an amount of secondary air being received by the burner 47.

Referring to FIG. 1, the control system 13 is provided to control an amount of air and coal received by the burners 47, 48, 50, 52 and air received by the air port 53. In particular, the control system 13 is provided to control A/F ratios at the burners 47, 48, 50, 52 and air injection port 53 to control CO levels, temperature levels, and a rate of slag formation at predetermined locations in the boiler system 12. Further, control system 13 is provided to control an amount of a slag reducing compound delivered to the burners 47, 48, 50, 52. The control system 13 includes electrically controlled primary air and coil valves 80, 82, 84, 86, 88, a combustion air actuator 90, an overfire air actuator 92, CO sensors 94, 96, 98, 99, temperature sensors 110, 112, 114, 115, slag detection sensors 116, 118, 120, 121, mass air flow sensors 117, 119, a coal flow sensor 123, a slag reducing compound delivery device 125, and a controller 122. It should be noted that for purposes of discussion, it is presumed that the CO sensor 94, the temperature sensor 110, and the slag detection sensor 116 are disposed substantially at a first location within the boiler system 12. Further, the CO sensor 96, the temperature sensor 112, the slag detection sensor 118 are disposed substantially at a second location within the boiler system 12. Further, the CO sensor 98, the temperature sensor 114, the slag detection sensor 120 are disposed substantially at a third location within the boiler system 12. Still further, the CO sensor 99, the temperature sensor 115, and the slag detection sensor 121 are disposed substantially at a fourth location with the boiler system 12. Of course, it should be noted that in alternative embodiments the CO sensors, temperature sensors, and slag detection sensors can be disposed in different locations with respect to one another. Further, in an alternate embodiment, the CO sensors 94, 96, 98, 99 are disposed away from the first, second, third, and fourth locations respectively in the boiler system 12 and the CO levels at the first, second, third and fourth locations are estimated from the signals of CO sensors 94, 96, 98, 99, respectively, utilizing computational fluid dynamic techniques known to those skilled in the art. Further, in an alternate embodiment, the temperature sensors 110, 112, 114, 115 are disposed away from the first, second, third, and fourth locations, respectively, and the temperature levels at the first, second, third, and fourth locations are estimated from the signals of temperature sensors 110, 112, 114, 115, respectively utilizing computational fluid dynamic techniques known to those skilled in the art. Further, in an alternate embodiment, the slag detection sensors 116, 118, 120, 121 are disposed away from the first, second, third, and fourth locations, respectively, and the slag thickness levels are estimated from the signals of the slag detection sensors 116, 118, 120, 121, respectively, utilizing computational fluid dynamic techniques known to those skilled in the art.

The electrically controlled valves 80, 82, 84, 86, 88 are provided to control an amount of primary air or transport air delivered to the burners 47, 48, 50, 52 and conduit 68, respectively, in response to control signals (FV1), (FV2), (FV3), (FV4), (FV5), respectively, received from the controller 122. The primary air carries coal particles to the burners.

The actuator 90 is provided to control an operational position of the throttle valve 45 in the air intake manifold 44 for adjusting an amount of combustion air provided to the burners 47, 48, 50, 52, in response to a control signal (AV1) received from the controller 122.

The actuator 92 is provided to control an operational position of the throttle valve 46 for adjusting an amount of overfire air provided to the air port 53, in response to a control signal (AV2) received from the controller 122.

The CO sensors 94, 96, 98, 99 are provided to generate signals (CO1), (CO2), (CO3), (CO4) indicative of CO levels at the first, second, third, and fourth locations, respectively, within the boiler system 12. It should be noted that in an alternative embodiment, the number of CO sensors within the boiler system 12 can be greater than four CO sensors. For example, in an alternative embodiment, a bank of CO sensors can be disposed within the boiler system 12. As shown, the CO sensors 94, 96, 98, 99 are disposed in the back pass portion 42 of the boiler system 12. It should be noted that in an alternative embodiment, the CO sensors can be disposed in a plurality of other positions within the boiler system 12. For example, the CO sensors can be disposed at an exit plane of the boiler system 12.

The temperature sensors 110, 112, 114, 115 are provided to generate signals (TEMP1), (TEMP2), (TEMP3), (TEMP4) indicative of temperature levels at the first, second, third and fourth locations, respectively, within the boiler system 12. It should be noted that in an alternative embodiment, the number of temperature sensors within the boiler system 12 can be greater than four temperature sensors. For example, in an alternative embodiment, a bank of temperature sensors can be disposed within the boiler system 12. As shown, the temperature sensors 110, 112, 114, 115 are disposed in the furnace exit plane portion 42 of the boiler system 12. It should be noted that in an alternative embodiment, the temperature sensors can be disposed in a plurality of other positions within the boiler system 12. For example, the temperature sensors can be disposed at an exit plane of the boiler system 12.

The slag detection sensors 116, 118, 120, 121 are provided to generate signals (SLAG1), (SLAG2), (SLAG3), (SLAG4) indicative of slag thicknesses at the first, second, third, and fourth locations, respectively, within the boiler system 12. It should be noted that in an alternative embodiment, the number of slag detection sensors within the boiler system 12 can be greater than four slag detection sensors. For example, in an alternative embodiment, a bank of slag detection sensors can be disposed within the boiler system 12. As shown, the slag detection sensors 116, 118, 120, 121 are disposed in the back path portion 42 of the boiler system 12. It should be noted that in an alternative embodiment, the slag detection sensors can be disposed in a plurality of other positions within the boiler system 12. For example, the slag detection sensors can be disposed at an exit plane of the boiler system 12.

The mass flow sensor 119 is provided to generate a (MAF1) signal indicative of an amount of primary air being supplied to the conduit 59, that is received by the controller 122.

The mass flow sensor 117 is provided to generate a (MAF2) signal indicative of an amount of combustion air being supplied to the intake manifold 44 and the burners and air ports, that is received by the controller 122.

The coal flow sensor 123 is provided to generate a (CF) signal indicative of an amount of coal being supplied to the conduit 59, that is received by the controller 122.

The slag reducing compound delivery device 125 is provided to deliver a predetermined amount of a slag reducing compound (to the burners 47, 48, 50, 52 for reducing slag formation at predetermined locations within the boiler system. The device 125 includes an internal reservoir (not shown) holding the slag reducing compound which is coupled to a pump (not shown). In response to a control signal (S1) from the controller 122, the pump routes predetermined amounts of the slag reducing compound from the reservoir to one or more of the conduits 150, 152, 154, 156 which are fluidly coupled to the burners 47, 48, 50, 52, respectively. The slag reducing compound can comprise any chemical additive or compound which reduces and/or prevents slag formation in the boiler system 12. In an exemplary embodiment, the slag reducing compounds react with slag forming agents (unburned hydrocarbons) in the fuel flow and cause the forming agents to have a higher melting point so that the forming agents are solid when they touch surfaces of boiler walls and superheater tubes and thus can be easily removed from the walls and tubes. Further, the slag is made more friable or "brittle" so that it can be easily removed from the walls and tubes. Older slag deposits remain loose and do not fuse with the boiler structure allowing easy removal. In other words, after slag forming agents react with the slag reducing compounds, the resultant compounds can only melt at temperatures greater than temperatures present in the boiler. When the resultant compounds are not in a molten state, they are not sticky. Thus slag will not form. When the resultant compounds are no longer molten, they are no longer corrosive as well. Further, there are certain slag reducing compounds that lower unburned carbon in the ash, which also reduces the rate of slag formation. In an exemplary embodiment, the slag reducing compound comprises a heat activated silicate such as ferro-magnesium alumino-silicate, sold under the trademark "FuelSolv", that increases a melting temperature for unburned hydrocarbons.

The controller 122 is provided to generate control signals to control operational positions of the valves 80, 82, 84, 86, 88 and actuators 90, 92 for obtaining a desired A/F ratio and air-fuel mass flow at the burners 47, 48, 50, 52. Further, the controller 122 is provided to generate a control signal (S1) for controlling an amount of slag reducing compound delivered to at least one of the burners 47, 40, 50, 52. Further, the controller 122 is provided to receive signals (CO1-CO4) from the CO sensors 94, 96, 98, 99 indicative of CO levels at the first, second, third and fourth locations and to determine the CO levels therefrom. Further, the controller 122 is provided to receive signals (TEMP1-TEMP4) from the temperature sensors 110, 112, 114, 115 indicative of temperature levels at the first, second, third, and fourth locations and to determine temperature levels therefrom. Still further, the controller 122 is provided to receive signals (SLAG1-SLAG4) from the slag detection sensors 116, 118, 120, 121 indicative of slag thicknesses at the first, second, third, and fourth locations and to determine slag thicknesses therefrom. The controller 122 includes a central processing unit (CPU) 130, a read-only memory (ROM) 132, a random access memory (RAM) 134, and an input-output (I/O) interface 136. Of course any other conventional types of computer storage media could be utilized including flash memory or the like, for example. The CPU 30 executes the software algorithms stored in at least one of the ROM 132 and the RAM 134 for implementing the control methodology described below.

Figure 2:
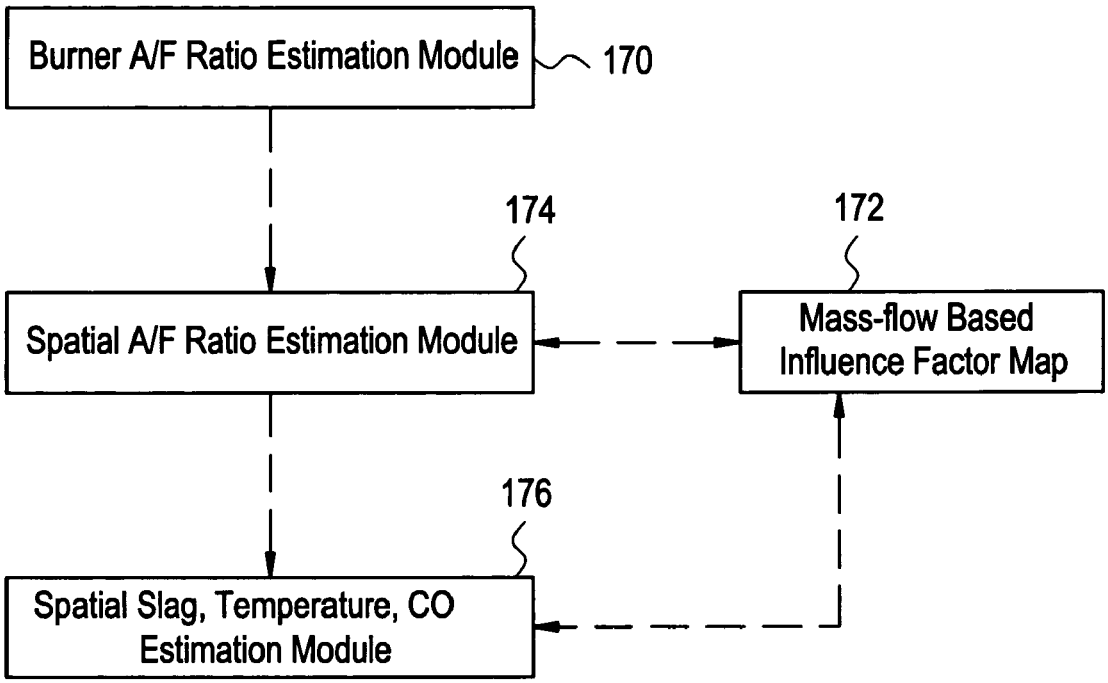
FIG. 2 is a block diagram of software algorithms utilized in the control system of FIG. 1.
Figure 3:
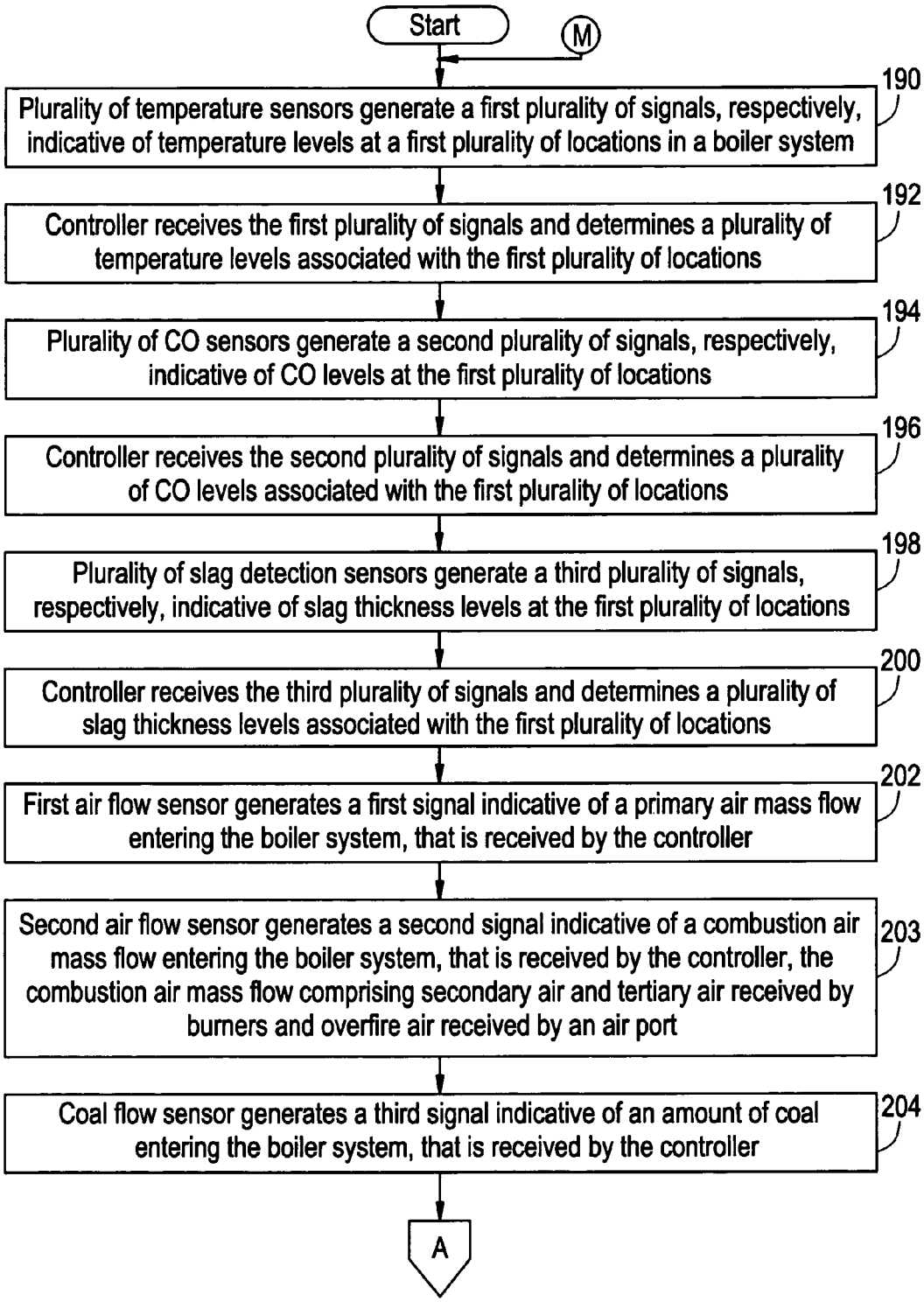
FIGS. 3-11 are flowcharts of a method for decreasing a rate of slag formation in predetermined locations of the boiler system of FIG. 1 in accordance with another exemplary embodiment.
Figure 4:
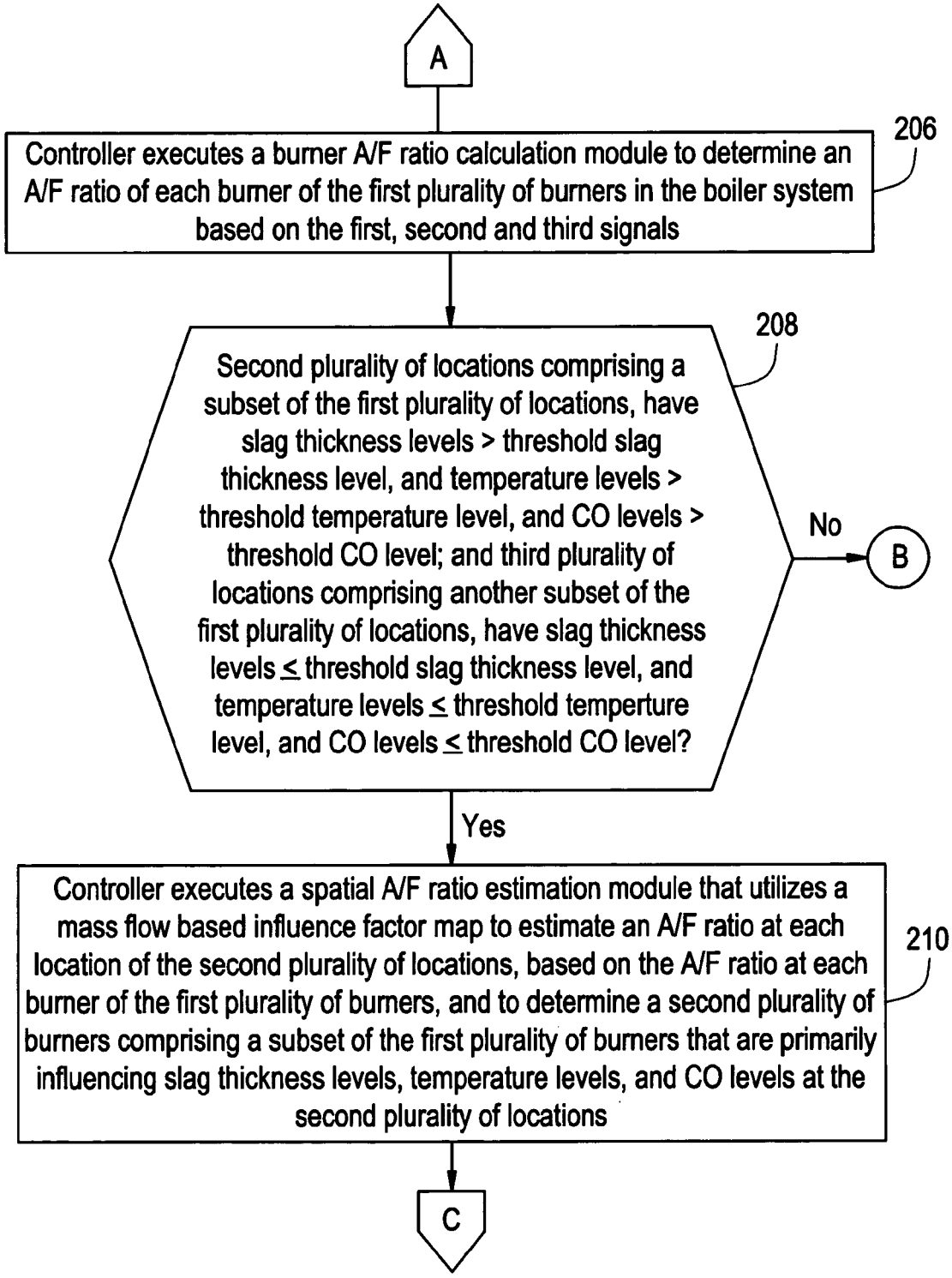
Figure 5:
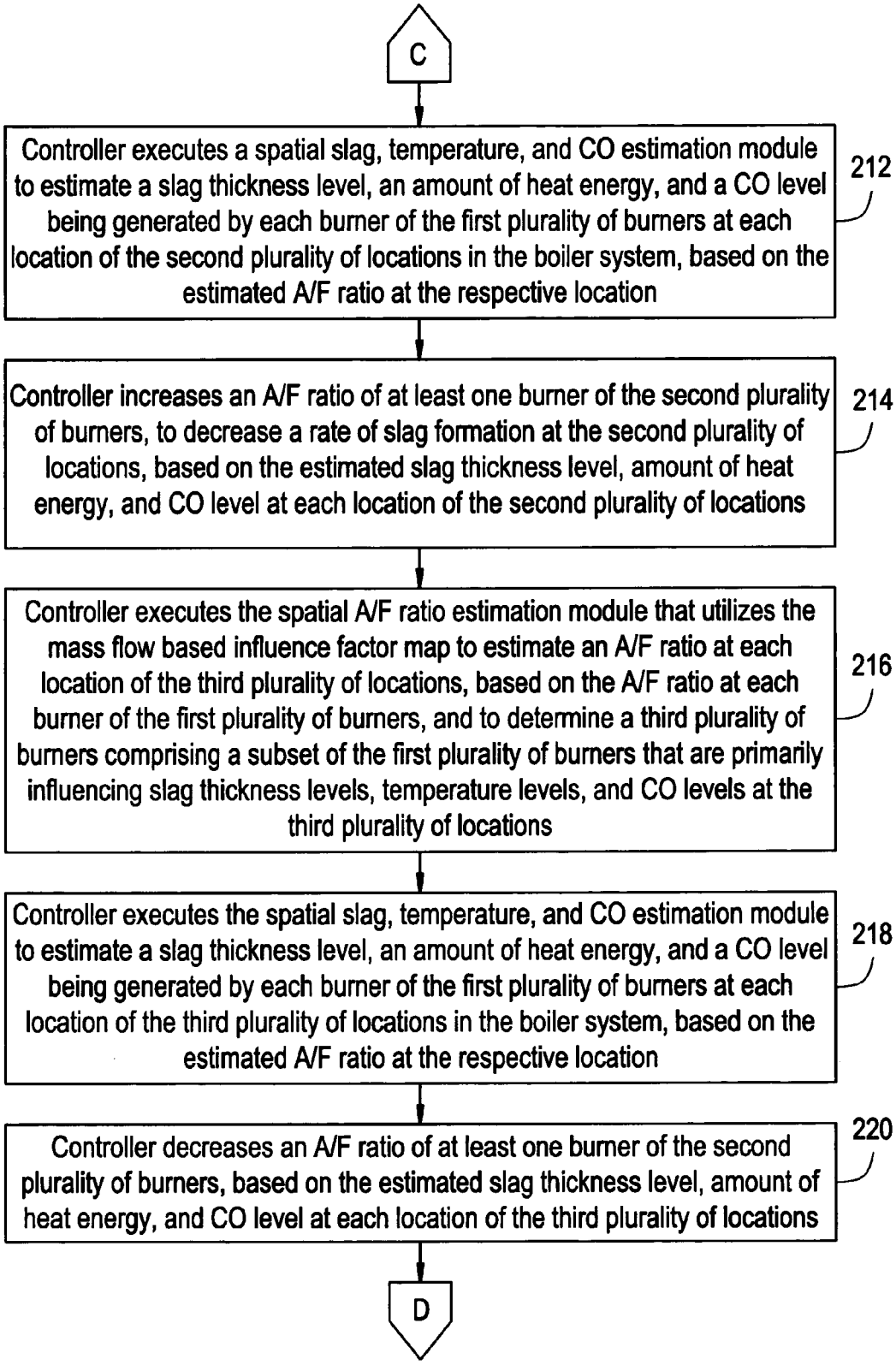

Referring to FIG. 2, a block diagram of the software algorithms executed by the controller 122 is illustrated. In particular, the software algorithms include a burner A/F ratio estimation module 170, a mass flow based influence factor map 172, a spatial A/F ratio estimation module 174, and a spatial slag, temperature, and CO estimation module 176.

The burner A/F ratio estimation module 170 is provided to calculate an A/F ratio at each of the burners 47, 48, 50, 52. In particular, the module 170 calculates the A/F ratio and each of the burners based upon the amount of primary air, secondary air, and tertiary air being provided to the burners 47, 48, 50, 52 and an amount of coal being provided by the coal pulverizer 22.

The mass flow based influence factor map 172 comprises a table that correlates a mass flow amount of exhaust gases from each burner to each of the first, second, third, and fourth locations within the boiler system 12. The controller 122 can utilize the mass flow based influence factor map 172 to determine which burners are primarily affecting particular locations within the boiler system 12. In particular, the controller 122 can determine that a particular burner is primarily affecting a particular location within the boiler system 12 by determining that a mass flow value from the particular burner to the particular location is greater than a threshold mass flow value.

In an alternative embodiment, the mass flow based influence factor map 172 comprises a table that indicates a percentage value indicating a percentage of the mass flow from each burner that flows to each of the first, second, third, and fourth locations. The controller 122 can determine that a particular burner is primarily affecting a particular location within the boiler system 12 by determining that a percentage value associated with a particular burner and a particular location is greater than a threshold percentage value. For example, the table could indicate that 10% of the mass flow at the first location is from the burner 47. If the threshold percentage value is 5% then the controller 122 would determine burner 47 is primarily affecting the mass flow at the first location.

The mass flow based influence factor map 172 can be determined using isothermal physical models and fluid dynamic scaling techniques of the boiler system 12 or computational fluid dynamic models of the boiler system 12.

The spatial A/F ratio estimation module 174 is provided to calculate an A/F ratio at each of the first, second, third, and fourth locations in the boiler system 12. In particular, the module 174 utilizes the A/F ratios associated with each of the burners, and the mass flow based influence factor map 172, to calculate an A/F ratio at each of the first, second, third, and fourth locations in the boiler system 12.

The spatial slag, temperature and CO estimation module 176 is provided to calculate a slag thickness level, an amount of heat energy, and a CO level at each of the first, second, third, and fourth locations in the boiler system 12 generated by each of the burners 47, 48, 50, and 52. In particular, the module 176 utilizes the spatial A/F ratio at each of the first, second, third, and fourth locations to estimate the slag thickness level, the amount of heat energy, and the CO levels generated by each of the burners 47, 48, 50, 52 at the first, second, third, and fourth locations.

Referring to FIGS. 3-11, a method for decreasing a rate of slag formation in predetermined regions in the boiler system 12 will now be explained. The method can be implemented utilizing software algorithms executed by the controller 122.

At step 190, a plurality of temperature sensors generate a first plurality of signals, respectively, indicative of temperature levels at a first plurality of locations in a boiler system 12. For example, the temperature sensors 110, 112, 114, 115 can generate signals (TEMP1), (TEMP2), (TEMP3), (TEMP4) respectively, indicative of temperature levels at the first, second, third, and fourth locations, respectively in the boiler system 12.

At step 192, the controller 122 receives the first plurality of signals and determines a plurality of temperature levels associated with the first plurality of locations. For example, the controller 122 can receive the signals (TEMP1), (TEMP2), (TEMP3), (TEMP4) and determine first, second, third, and fourth temperature levels, respectively, associated with the first, second, third, and fourth locations, respectively.

At step 194, a plurality of CO sensors generate a second plurality of signals, respectively, indicative of CO levels at the first plurality of locations. For example, the CO sensors 94, 96, 98, 99 can generate signals (CO1), (CO2), (CO3), (CO4) respectively, indicative of CO levels at the first, second, third, and fourth locations, respectively.

At step 196, the controller 122 receives the second plurality of signals and determines a plurality of CO levels associated with the first plurality of locations. For example, the controller 122 can receive the signals (CO1), (CO2), (CO3), (CO4), and determine first, second, third and fourth CO levels, respectively, associated with the first, second, third, and fourth locations, respectively.

At step 198, a plurality of slag detection sensors generate a third plurality of signals, respectively, indicative of slag thickness levels at the first plurality of locations. For example, the slag detection sensors 116, 118, 120, 121 can generate signals (SLAG1), (SLAG2), (SLAG3), (SLAG4) respectively, indicative of slag thickness levels at the first, second, third, and fourth locations, respectively.

At step 200, the controller 122 receives the third plurality of signals and determines a plurality of slag thickness levels associated with the first plurality of locations. For example, the controller 122 can receive the signals (SLAG1), (SLAG2), (SLAG3), (SLAG4) and determine first, second, third, and fourth slag thickness levels, respectively, associated with the first, second, third, and fourth locations, respectively.

At step 202, the air flow sensor 119 generates the (MAF1) signal indicative of a primary air mass flow entering the boiler system 12, that is received by the controller 122.

At step 203, the air flow sensor 117 generates the (MAF2) signal indicative of a combustion air mass flow entering the intake manifold 44, that is received by the controller 122. The combustion air mass flow comprises the secondary air and tertiary air received by the burners and the overfire air received by the air port 53.

At step 204, the coal flow sensor 123 generates the (CF) signal indicative of an amount of coal (e.g., total mill coal flow) entering the boiler system 12, that is received by the controller 122. Of course, in an alternative embodiment, the amount of coal being received by each burner can be calculated or monitored using coal flow sensors disposed in each burner or fluidly communicating with each burner.

At step 206, the controller 122 executes the burner A/F ratio calculation module 170 to determine an A/F ratio of each burner of the first plurality of burners in the boiler system based on the (MAF1) signal, the (MAF2) signal, and the (CF) signal. For example, the controller 122 can execute the burner A/F ratio calculation module 170 to determine A/F ratios for the burners 47, 48, 50, 52 based on the (MAF1) signal, the (MAF2) signal, and the (CF) signal.

At step 208, the controller 122 makes a determination as to whether (i) a second plurality of locations comprising a subset of the first plurality of locations, have slag thickness levels greater than a threshold slag thickness level, and temperature levels greater than a threshold temperature level, and CO levels greater than a threshold CO level, and (ii) a third plurality of locations comprising another subset of the first plurality of locations have slag thickness levels less than or equal to the threshold slag thickness level, and temperature levels less than or equal to the threshold temperature level, and CO levels less than or equal to the threshold CO level. If the value of step 208 equals "yes", the method advances to step 210. Otherwise, the method advances to step 222.

At step 210, the controller 122 executes the spatial A/F ratio estimation module 174 that utilizes a mass flow based influence factor map 172 to estimate an A/F ratio at each location of the second plurality of locations, based on the A/F ratio at each burner of the first plurality of burners, and to determine a second plurality of burners comprising a subset of the first plurality of burners that are primarily influencing slag thickness levels, temperature levels, and CO levels at the second plurality of locations. For example, the controller 122 can execute the module 174 that utilizes the mass flow based influence factor map 172 to determine A/F ratios at the first and second locations, based on the A/F ratio at each of the burners 47, 48, 50, 52. Further, for example, the controller 142 can determine that the burners 47, 48 are primarily influencing the slag thickness levels, temperature levels, and CO levels at the first and second locations in the boiler system 12.

At step 212, the controller 122 executes the spatial slag, temperature, and CO estimation module 176 to estimate a slag thickness level, an amount of heat energy, and a CO level being generated by each burner of the first plurality of burners at each location of the second plurality of locations in the boiler system, based on the estimated A/F ratio at the respective location. For example, the controller 122 can execute the module 176 to estimate a slag thickness level, an amount of heat energy, and a CO level generated by each of the burners 47, 40, 50, 52 at the first and second locations in the boiler system 12, based on the A/F ratios at the first and second locations.

At step 214, the controller 122 increases an A/F ratio of at least one burner of the second plurality of burners, to decrease a rate of slag formation at the second plurality of locations, based on the estimated slag thickness level, amount of heat energy, and CO level at each location of the second plurality of locations. For example, the controller 122 can increase an A/F ratio of a least one of the burners 47, 48, based on the estimated slag thickness level, and amount of heat energy, a CO level generated by the burners 47, 48, 50, 52 at the first and second locations in the boiler system 12. In one exemplary embodiment, the controller 122 increases the A/F ratio by decreasing a fuel mass flow into at least one of the burners 47, 48 while either maintaining or decreasing an air mass flow being delivered to at least one of the burners 47, 48.

At step 216, the controller 122 executes the spatial A/F ratio estimation module 174 that utilizes the mass flow based influence factor map 172 to estimate an A/F ratio at each location of the third plurality of locations, based on the A/F ratio at each burner of the first plurality of burners, and to determine a third plurality of burners comprising a subset of the first plurality of burners that are primarily influencing slag thickness levels, temperature levels, and CO levels at the third plurality of locations. For example, the controller 122 can execute the module 174 that utilizes the mass flow based influence factor map 172 to determine A/F ratios at the third and fourth locations, based on the A/F ratio each of the burners 47, 48, 50, 52. Further, for example, the controller 142 can determine that the burners 50, 52 are primarily influencing the slag thickness levels, temperature levels, and CO levels at the third and fourth locations in the boiler system 12.

At step 218, the controller 122 executes the spatial slag, temperature, and CO estimation module 176 to estimate a slag thickness level, an amount of heat energy, and a CO level being generated by each burner of the first plurality of burners at each location of the third plurality of locations in the boiler system, based on the estimated A/F ratio at the respective location. For example, the controller 122 can execute the module 176 to estimate a slag thickness level, an amount of heat energy, and a CO level generated by the burners 47, 40, 50, 52 at the third and fourth locations in the boiler system 12, based on the A/F ratios at the third and fourth locations.

At step 220, the controller 122 decreases an A/F ratio of at least one burner of the second plurality of burners, based on the estimated slag thickness level, amount of heat energy, and CO level at each location of the third plurality of locations. For example, the controller 122 can decrease an A/F ratio of a least one of the burners 50, 52 based on the estimated slag thickness level, and amount of heat energy, a CO level generated by the burners 47, 48, 50, 52 at the third, and fourth locations in the boiler system 12. In one exemplary embodiment, the controller 122 decreases the A/F ratio by decreasing in air mass flow into at least one of the burners 50, 52 while either maintaining or decreasing a fuel mass flow being delivered to at least one of the burners 50, 52.

At step 222, the controller 122 makes a determination as to whether (i) a fourth plurality of locations comprising a subset of the first plurality of locations, have slag thickness levels greater than the threshold slag thickness level, and temperature levels greater than the threshold temperature level, and CO levels less than or equal to the threshold CO level, and (ii) a fifth plurality of locations comprising another subset of the first plurality of locations, have slag thickness levels less than or equal to the threshold slag thickness level, and temperature levels less than or equal to the threshold temperature level, and CO levels greater than the threshold CO level. If the value of step 222 equals "yes", the method advances to step 224. Otherwise, the method advances to step 236.

At step 224, the controller 122 executes the spatial A/F ratio estimation module 170 that utilizes the mass flow based influence factor map 172 to estimate an A/F ratio at each location of the fourth plurality of locations, based on the A/F ratio at each burner of the first plurality of burners, and to determine a fourth plurality of burners comprising a subset of the first plurality of burners that are primarily influencing slag thickness levels, temperature levels, and CO levels at the fourth plurality of locations.

At step 226, the controller 122 executes the spatial slag, temperature, and CO estimation module 176 to estimate a slag thickness level, an amount of heat energy, and a CO level being generated by each burner of the first plurality of burners at each location of the fourth plurality of locations in the boiler system 12, based on the estimated A/F ratio at the respective location.

At step 228, the controller 122 decreases at least one of an A/F ratio of at least one burner of the fourth plurality of burners and an air-fuel mass flow to the at least one burner of the fourth plurality of burners, to decrease a rate of slag formation at the fourth plurality of locations, based on the estimated slag thickness level, amount of heat energy, and CO level at each location of the fourth plurality of locations.

At step 230, the controller 122 executes the spatial A/F ratio estimation module 174 that utilizes the mass flow based influence factor map 172 to estimate an A/F ratio at each location of the fifth plurality of locations, based on the A/F ratio at each burner of the first plurality of burners, and to determine a fifth plurality of burners comprising a subset of the first plurality of burners that are primarily influencing slag thickness levels, temperature levels, and CO levels at the fifth plurality of locations.

At step 232, the controller 122 executes the spatial slag, temperature, and CO estimation module 176 to estimate a slag thickness level, an amount of heat energy, and a CO level being generated by each burner of the first plurality of burners at each location of the fifth plurality of locations in the boiler system 12, based on the estimated A/F ratio at the respective location.

At step 234, the controller 122 increases at least one of an A/F ratio of at least one burner of the fifth plurality of burners and an air-fuel mass flow to the at least one burner of the fifth plurality of burners, based on the estimated slag thickness level, amount of heat energy, and CO level at each location of the fifth plurality of locations.

At step 236, the controller 122 makes a determination as to whether (i) a sixth plurality of locations comprising a subset of the first plurality of locations, have slag thickness levels greater than the threshold slag thickness level, and temperature levels less than or equal to the threshold temperature level, and CO levels greater than the threshold CO level, and (ii) a seventh plurality of locations comprising another subset of the first plurality of locations, have slag thickness levels less than or equal to the threshold slag thickness level, and temperature levels greater than the threshold temperature level, and CO levels less than or equal to the threshold CO level. If the value of step 236 equals "yes", the method advances to step 238. Otherwise, the method advances to step 250.

At step 238, the controller 122 executes the spatial A/F ratio estimation module 174 that utilizes the mass flow based influence factor map 172 to estimate an A/F ratio at each location of the sixth plurality of locations, based on the A/F ratio at each burner of the first plurality of burners, and to determine a sixth plurality of burners comprising a subset of the first plurality of burners that are primarily influencing slag thickness levels, temperature levels, and CO levels at the sixth plurality of locations.

At step 240, the controller 122 executes the spatial slag, temperature, and CO estimation module 176 to estimate a slag thickness level, an amount of heat energy, and a CO level being generated by each burner of the first plurality of burners at each location of the sixth plurality of locations in the boiler system 12, based on the estimated A/F ratio at the respective location.

At step 242, the controller 122 increases an A/F ratio of at least one burner of the sixth plurality of burners to decrease a rate of slag formation at the sixth plurality of locations, based on the estimated slag thickness level, amount of heat energy, and CO level at each location of the sixth plurality of locations.

At step 244, the controller 122 executes the spatial A/F ratio estimation module 174 that utilizes the mass flow based influence factor map 172 to estimate an A/F ratio at each location of the seventh plurality of locations, based on the A/F ratio at each burner of the first plurality of burners, and to determine a seventh plurality of burners comprising a subset of the first plurality of burners that are primarily influencing slag thickness levels, temperature levels, and CO levels at the seventh plurality of locations.

At step 246, the controller 122 executes the spatial slag, temperature, and CO estimation module 176 to estimate a slag thickness level, an amount of heat energy, and a CO level being generated by each burner of the first plurality of burners at each location of the seventh plurality of locations in the boiler system 12, based on the estimated A/F ratio at the respective location.

At step 248, the controller 122 decreases at least one of an A/F ratio of at least one burner of the seventh plurality of burners, based on the estimated slag thickness level, amount of heat energy, and CO level at each location of the seventh plurality of locations.

At step 250, the controller 122 makes a determination as to whether (i) an eighth plurality of locations comprising a subset of the first plurality of locations, have slag thickness levels greater than the threshold slag thickness level, and temperature levels less than or equal to the threshold temperature level, and CO levels less than or equal to the threshold CO level, and (ii) a ninth plurality of locations comprising another subset of the first plurality of locations, have slag thickness levels less than or equal to the threshold slag thickness level, and temperature levels greater than the threshold temperature level, and CO levels greater than the threshold CO level. If the value of step 250 equals "yes", the method advances to step 252. Otherwise, the method advances to step 264.

At step 252, the controller 122 executes the spatial A/F ratio estimation module 174 that utilizes the mass flow based influence factor map 172 to estimate an A/F ratio at each location of the eighth plurality of locations, based on the A/F ratio at each burner of the first plurality of burners, and to determine an eighth plurality of burners comprising a subset of the first plurality of burners that are primarily influencing slag thickness levels, temperature levels, and CO levels at the eighth plurality of locations.

At step 254, the controller 122 executes the spatial slag, temperature, and CO estimation module 176 to estimate a slag thickness level, an amount of heat energy, and a CO level being generated by each burner of the first plurality of burners at each location of the eighth plurality of locations in the boiler system 12, based on the estimated A/F ratio at the respective location.

At step 256, the controller 122 decreases at least one of an air-fuel mass flow to the at least one burner of the eighth plurality of burners, and a fuel mass flow to the at least one burner of the eighth plurality of burners, to decrease a rate of slag formation at the eighth plurality of locations, based on the estimated slag thickness level, amount of heat energy, and CO level at each location of the eighth plurality of locations.

At step 258, the controller 122 executes the spatial A/F ratio estimation module 174 that utilizes the mass flow based influence factor map 172 to estimate an A/F ratio at each location of the ninth plurality of locations, based on the A/F ratio at each burner of the first plurality of burners, and to determine a ninth plurality of burners comprising a subset of the first plurality of burners that are primarily influencing slag thickness levels, temperature levels, and CO levels at the ninth plurality of locations.

At step 260, the controller 122 executes the spatial slag, temperature, and CO estimation module 176 to estimate a slag thickness level, an amount of heat energy, and a CO level being generated by each burner of the first plurality of burners at each location of the ninth plurality of locations in the boiler system, based on the estimated A/F ratio at the respective location.

At step 262, the controller 122 increases at least one of an air-fuel mass flow to the at least one burner of the ninth plurality of burners, and a fuel mass flow to the at least one burner of the ninth plurality of burners, based on the estimated slag thickness level, amount of heat energy, and CO level at each location of the ninth plurality of locations.

At step 264, the controller 122 makes a determination as to whether (i) the boiler system 12 has a slag reducing compound delivery device, and (ii) a tenth plurality of locations comprising a subset of the first plurality of locations, having slag thickness levels greater than the threshold slag thickness level. If the value of step 264 equals "yes", the method advances step 266. Otherwise, the method returns to step 190.

At step 266, the controller 122 executes the spatial A/F ratio estimation module 174 that utilizes the mass flow based influence factor map 172 to determine a tenth plurality of burners comprising a subset of the first plurality of burners that are primarily influencing slag thickness levels, temperature levels, and CO levels at the tenth plurality of locations.

At step 268, the controller 122 induces the slag reducing compound delivery device 125 to deliver a slag reducing compound to the tenth plurality of burners for reducing a rate of slag formation at the tenth plurality of locations. After step 268, the method returns to step 190.

The inventive system, and method for decreasing a rate of slag formation in predetermined locations within a boiler system provide a substantial advantage over other system and methods. In particular, these embodiments provide a technical effect of adjusting at least one of A/F ratios, air-fuel mass flows, fuel mass flows, and slag reducing compounds to predetermined burners to decrease a rate of slag formation at predetermined locations in the boiler system.

The above-described methods can be embodied in the form of computer program code containing instructions embodied in tangible media, such as floppy diskettes, CD ROMs, hard drives, or any other computer-readable storage medium, wherein, when the computer program code is loaded into and executed by a computer, the computer becomes an apparatus for practicing the invention.

While the invention is described with reference to an exemplary embodiment, it will be understood by those skilled in the art that various changes may be made and equivalence may be substituted for elements thereof without departing from the scope of the invention. In addition, many modifications may be made to the teachings of the invention to adapt to a particular situation without departing from the scope thereof. Therefore, it is intended that the invention not be limited to the embodiment disclosed for carrying out this invention, but that the invention includes all embodiments falling with the scope of the intended claims. Moreover, the use of the term's first, second, etc. does not denote any order of importance, but rather the term's first, second, etc. are used to distinguish one element from another.

What is claimed is:

1. A method for decreasing a rate of slag formation in predetermined locations within a boiler system, the boiler system having first, second, third, and fourth burners disposed therein, the method comprising:

receiving first, second, third, and fourth signals from first, second, third, and fourth temperature sensors, respectively, disposed substantially at first, second, third, and fourth locations, respectively, in the boiler system between the first, second, third, and fourth burners, respectively, and an exit plane of the boiler system;

determining first, second, third, and fourth temperature levels at the first, second, third, and fourth locations, respectively, in the boiler system based on the first, second, third, and fourth signals, respectively;

receiving fifth, sixth, seventh, and eighth signals from first, second, third, and fourth CO sensors, respectively, disposed substantially at the first, second, third, and fourth locations, respectively, in the boiler system;

determining first, second, third, and fourth CO levels at the first, second, third, and fourth locations, respectively, based on the fifth, sixth, seventh, and eighth signals, respectively;

receiving ninth, tenth, eleventh, and twelfth signals from first, second, third, and fourth slag detection sensors, respectively, disposed substantially at the first, second, third, and fourth locations, respectively, in the boiler system;

determining first, second, third, and fourth slag thickness levels at the first, second, third, and fourth locations, respectively, based on the ninth, tenth, eleventh, and twelfth signals, respectively;

determining the first and second locations have the first and second slag thickness levels, respectively, greater than a threshold slag thickness level, and the first and second temperature levels, respectively, greater than a threshold temperature level, and the first and second CO levels, respectively, greater than a threshold CO level;

determining the first and second burners in the boiler system are contributing to the first and second locations having the first and second slag thickness levels greater than the threshold slag thickness level, and the first and second temperature levels greater than the threshold temperature level, and the first and second CO levels greater than the threshold CO level, utilizing a mass-flow based influence factor map; and increasing an A/F ratio of at least one burner of the first and second burners, to decrease the rate of slag formation at the first and second locations.

2. The method of claim 1, wherein determining the first and second burners, comprises:

accessing the mass-flow based influence factor map indicating an air-fuel mass flow or a percentage mass flow at each location of the first and second locations from each burner of the first, second, third, and fourth burners; and identifying burners from the first, second, third and fourth burners having an air-fuel mass flow or a percentage mass flow greater than a predetermined value, to determine the first and second burners.

3. The method of claim 1, wherein increasing the A/F ratio of at least one burner of the first and second burners includes decreasing a fuel mass flow into the at least one burner of the first and second burners while either maintaining or decreasing an air mass flow being delivered to the at least one burner of the first and second burners.

4. The method of claim 1, further comprising:

determining the third and fourth locations have the third and fourth slag thickness levels, respectively, less than or equal to the threshold slag thickness level, or the third and fourth temperature levels, respectively, less than or equal to the threshold temperature level, or the third and fourth CO levels, respectively, less than or equal to the threshold CO level;

determining the third and fourth burners in the boiler system are contributing to the third and fourth locations having the third and fourth slag thickness levels less than or equal to the threshold slag thickness level, or the third and fourth temperature levels less than or equal to the threshold temperature levels, or the third and fourth CO levels less than or equal to the threshold CO level, utilizing a mass-flow based influence factor map; and decreasing an A/F ratio of at least one burner of the third and fourth burners.

5. The method of claim 4, wherein decreasing the A/F ratio of at least one burner of the third and fourth burners includes decreasing an air mass flow into the at least one burner of the third and fourth of burners while either maintaining or decreasing a fuel mass flow being delivered to the at least one burner of the third and fourth burners.

6. A control system for decreasing a rate of slag formation in predetermined locations within a boiler system, the boiler system having first, second, third, and fourth burners disposed therein, the control system comprising:

first, second, third, and fourth temperature sensors disposed substantially at first, second, third, and fourth locations, respectively, in the boiler system, between the first, second, third, and fourth burners, respectively, and an exit plane of the boiler system, the first, second, third, and fourth temperature sensors configured to generate first, second, third, and fourth signals, respectively, indicative of first, second, third, and fourth temperature levels, respectively, at the first, second, third, and fourth locations, respectively, in the boiler system;

first, second, third, and fourth CO sensors disposed substantially at the first, second, third, and fourth locations, respectively, in the boiler system, the first, second, third, and fourth CO sensors configured to generate fifth, sixth, seventh, and eighth signals, respectively, indicative of first, second, third, and fourth CO levels, respectively, at the first, second, third, and fourth locations, respectively, in the boiler system;

first, second, third, and fourth slag detection sensors disposed substantially at the first, second, third, and fourth locations, respectively, in the boiler system, the first, second, third, and fourth slag detection sensors configured to generate ninth, tenth, eleventh, and twelfth signals, respectively, indicative of first, second, third, and fourth slag thicknesses, respectively, at the first, second, third, and fourth locations, respectively, in the boiler system; and a controller operably coupled to the first, second, third, and fourth temperature sensors and to the first, second, third, and fourth CO sensors and to the first, second, third, and fourth slag detection sensors, the controller configured to determine the first, second, third, and fourth temperature levels at the first, second, third, and fourth locations, respectively, based on the first, second, third, and fourth signals, respectively;

the controller further configured to determine the first, second, third, and fourth CO levels at the first, second, third, and fourth locations, respectively, based on the fifth, sixth, seventh, and eighth signals, respectively;

the controller further configured to determine the first, second, third, and fourth slag thickness levels at the first, second, third, and fourth locations, respectively, based on the ninth, tenth, eleventh, and twelfth signals, respectively;

the controller further configured to determine the first and second locations have the first and second slag thickness levels, respectively, greater than a threshold slag thickness level, and the first and second temperature levels, respectively, greater than a threshold temperature level, and the first and second CO levels, respectively, greater than a threshold CO level;

the controller further configured to determine the first and second burners in the boiler system are contributing to the first and second locations having the first and second slag thickness levels greater than the threshold slag thickness level, and the first and second temperature levels greater than the threshold temperature level, and the first and second CO levels greater than the threshold CO level, utilizing a mass-flow based influence factor map;

the controller further configured to increase an A/F ratio of at least one burner of the first and second burners, to decrease the rate of slag formation at the first and second locations.

7. A method for decreasing a rate of slag formation in predetermined locations within a boiler system, the boiler system having first, second, third, and fourth burners disposed therein, the method comprising:

receiving first, second, third, and fourth signals from first, second, third, and fourth temperature sensors disposed substantially at first, second, third, and fourth locations, respectively, in the boiler system between the first, second, third, and fourth burners, respectively, and an exit plane of the boiler system;

determining first, second, third, and fourth temperature levels at the first, second, third, and fourth locations, respectively, in the boiler system based on the first, second, third, and fourth signals, respectively;

receiving fifth, sixth, seventh, and eighth signals from first, second, third, and fourth CO sensors, respectively, disposed substantially at the first, second, third, and fourth locations, respectively, in the boiler system;

determining first, second, third, and fourth CO levels at the first, second, third, and fourth locations, respectively, based on the fifth, sixth, seventh, and eighth signals, respectively;

receiving ninth, tenth, eleventh, and twelfth signals from first, second, third, and fourth slag detection sensors, respectively, disposed substantially at the first, second, third, and fourth locations, respectively, in the boiler system;

determining first, second, third, and fourth slag thickness levels at the first, second, third, and fourth locations, respectively, based on the ninth, tenth, eleventh, and twelfth signals, respectively;

determining the first and second locations have the first and second slag thickness levels, respectively, greater than a threshold slag thickness level, and the first and second temperature levels, respectively, greater than a threshold temperature level, and the first and second CO levels, respectively, less than or equal to a threshold CO level;

determining the first and second burners in the boiler system are contributing to the first and second locations having the first and second slag thickness levels greater than the threshold slag thickness level, and the first and second temperature levels greater than the threshold temperature level, and the first and second CO levels less than or equal to the threshold CO level, utilizing a mass-flow based influence factor map; and decreasing at least one of an A/F ratio of at least one burner of the first and second burners and an air-fuel mass flow to the at least one burner of the first and second burners, to decrease the rate of slag formation at the first and second locations.

8. The method of claim 7, wherein determining the first and second burners, comprises:

accessing the mass-flow based influence factor map indicating an air-fuel mass flow or a percentage mass flow at each location of the first and second locations from each burner of the first, second, third, and fourth burners; and identifying burners from the first, second, third, and fourth burners having an air-fuel mass flow or a percentage mass flow greater than a predetermined value, to determine the first and second burners.

9. The method of claim 7, wherein decreasing the air-fuel mass flow of at least one burner of the first and second burners comprises decreasing an air mass flow to the at least one burner of the first and second burners while maintaining or decreasing a fuel mass flow to the at least one burner of the first and second burners.

10. The method of claim 7, further comprising:

determining the third and fourth locations have the third and fourth slag thickness levels, respectively, less than or equal to the threshold slag thickness level, or the third and fourth temperature levels, respectively, less than or equal to the threshold temperature level, or the third and fourth CO levels, respectively, greater than the threshold CO level;

determining the third and fourth burners in the boiler system are contributing to the third and fourth locations having the third and fourth slag thickness levels less than or equal to the threshold slag thickness level or the third and fourth temperature levels less than or equal to the threshold temperature level, or the third and fourth CO levels greater than the threshold CO level, utilizing a mass-flow based influence factor map; and increasing at least one of an A/F ratio of at least one burner of the third and fourth burners and an air-fuel mass flow to the at least one burner of the third and fourth burners.

11. The method of claim 10, wherein increasing the air-fuel mass flow of at least one burner of the third and fourth burners comprises increasing an air mass flow to the at least one burner of the third and fourth burners while maintaining or increasing a fuel mass flow to the at least one burner of the third and fourth burners.

12. A control system for decreasing a rate of slag formation in predetermined locations within a boiler system, the boiler system having first, second, third, and fourth burners disposed therein, the control system comprising:

first, second, third, and fourth temperature sensors disposed substantially at first, second, third, and fourth locations, respectively, in the boiler system, between the first, second, third, and fourth burners, respectively, and an exit plane of the boiler system, the first, second, third, and fourth temperature sensors configured to generate first, second, third, and fourth signals, respectively, indicative of first, second, third, and fourth temperature levels, respectively, at the first, second, third, and fourth locations, respectively, in the boiler system;

first, second, third, and fourth CO sensors disposed substantially at the first, second, third, and fourth locations, respectively, in the boiler system, the first, second, third, and fourth CO sensors configured to generate fifth, sixth, seventh, and eighth signals, respectively, indicative of first, second, third, and fourth CO levels, respectively, at the first, second, third, and fourth locations, respectively, in the boiler system;

first, second, third, and fourth slag detection sensors disposed substantially at the first, second, third, and fourth locations, respectively, in the boiler system, the first, second, third, and fourth slag detection sensors configured to generate ninth, tenth, eleventh, and twelfth signals, respectively, indicative of first, second, third, and fourth slag thicknesses, respectively, at the first, second, third, and fourth locations, respectively, in the boiler system; and a controller operably coupled to the first, second, third, and fourth temperature sensors and to the first, second, third, and fourth CO sensors and to the first, second, third, and fourth slag detection sensors, the controller configured to determine the first, second, third, and fourth temperature levels at the first, second, third, and fourth locations, respectively, based on the first, second, third, and fourth signals, respectively;

the controller further configured to determine the first, second, third, and fourth CO levels at the first, second, third, and fourth locations, respectively, based on the fifth, sixth, seventh, and eighth signals;

the controller further configured to determine the first, second, third, and fourth slag thickness levels at the first, second, third, and fourth locations, respectively, based on the ninth, tenth, eleventh, and twelfth signals, respectively;

the controller further configured to determine the first and second locations have the first and second slag thickness levels, respectively, greater than a threshold slag thickness level, and the first and second temperature levels, respectively, greater than a threshold temperature level, and the first and second CO levels, respectively, less than or equal to a threshold CO level;

the controller further configured to determine the first and second burners in the boiler system are contributing to the first and second locations having the first and second slag thickness levels greater than the threshold slag thickness level, and the first and second temperature levels greater than the threshold temperature level, and the first and second CO levels less than or equal to the threshold CO level, utilizing a mass-flow based influence factor map;

the controller further configured to decrease at least one of an A/F ratio of at least one burner of the first and second burners and an air-fuel mass flow to the at least one burner of the first and second burners, to decrease the rate of slag formation at the first and second locations.

13. A method for decreasing a rate of slag formation in predetermined locations within a boiler system, the boiler system having first, second, third and fourth burners disposed therein, the method comprising:

receiving first, second, third, and fourth signals from first, second, third, and fourth temperature sensors disposed substantially at first, second, third, and fourth locations, respectively, in the boiler system between the first, second, third, and fourth burners, respectively, and an exit plane of the boiler system;

determining first, second, third, and fourth temperature levels at the first, second, third and fourth locations, respectively, in the boiler system based on the first, second, third, and fourth signals, respectively;

receiving fifth, sixth, seventh, and eighth signals from the first, second, third, and fourth CO sensors, respectively, disposed substantially at the first, second, third, and fourth locations, respectively, in the boiler system;

determining first, second, third, and fourth CO levels at the first, second, third, and fourth locations, respectively, based on the fifth, sixth, seventh, and eighth signals, respectively;

receiving ninth, tenth, eleventh, and twelfth signals from the first, second, third, and fourth slag detection sensors, respectively, disposed substantially at first, second, third, and fourth locations, respectively, in the boiler system;

determining first, second, third, and fourth slag thickness levels at the first, second, third, and fourth locations, respectively, based on the ninth, tenth, eleventh, and twelfth signals, respectively;

determining the first and second locations have the first and second slag thickness levels, respectively, greater than a threshold slag thickness level, and the first and second temperature levels, respectively, less than or equal to a threshold temperature level, and the first and second CO levels, respectively, greater than a threshold CO level;

determining the first and second burners in the boiler system are contributing to the first and second locations having the first and second slag thickness levels greater than the threshold slag thickness level, and the first and second temperature levels less than or equal to the threshold temperature level, and the first and second CO levels greater than the threshold CO level, utilizing a mass-flow based influence factor map; and increasing an A/F ratio of at least one burner of the first and second burners to decrease the rate of slag formation at the first and second locations.

14. The method of claim 13, wherein determining the first and second burners, comprises:

accessing the mass-flow based influence factor map indicating an air-fuel mass flow or a percentage mass flow at each location of the first and second locations from each burner of the first, second, third, and fourth burners; and identifying burners from the first, second, third, and fourth burners having an air-fuel mass flow or a percentage mass flow greater than a predetermined value, to determine the first and second burners.

15. The method of claim 13, wherein increasing the A/F ratio of at least one burner of the first and second burners comprises increasing an air mass flow while maintaining or decreasing a fuel mass flow to the first and second burners.

16. The method of claim 13, further comprising:

determining the third and fourth locations that have the third and fourth slag thickness levels, respectively, less than or equal to the threshold slag thickness level, or the third and fourth temperature levels greater than the threshold temperature level or the third and fourth CO levels less than or equal to the threshold CO level;

determining the third and fourth burners in the boiler system are contributing to the third and fourth locations having the third and fourth slag thickness levels less than or equal to the threshold slag thickness level, or the third and fourth temperature levels greater than the threshold temperature level, or the third and fourth CO levels less than or equal to the threshold CO level, utilizing a mass-flow based influence factor map; and decreasing at least one of an A/F ratio of at least one burner of the third and fourth burners and an air-fuel mass flow to the at least one burner of the third and fourth burners.

17. The method of claim 16, wherein decreasing the air-fuel mass flow of at least one burner of the third and fourth burners comprises decreasing an air mass flow and a fuel mass flow to the third and fourth burners.

18. A control system for decreasing a rate of slag formation in predetermined locations within a boiler system, the boiler system having first, second, third and fourth burners disposed therein, the control system comprising:

first, second, third, and fourth temperature sensors disposed substantially at first, second, third, and fourth locations, respectively, in the boiler system, between the first, second, third, and fourth burners, respectively, and an exit plane of the boiler system the first, second, third and fourth temperature sensors configured to generate a first, second, third and fourth signals, respectively, indicative of first, second, third, and fourth temperature levels, respectively, at the first, second, third, and fourth locations, respectively, in the boiler system;

first, second, third, and fourth CO sensors disposed substantially at the first, second, third, and fourth locations, respectively, in the boiler system, the first, second, third, and fourth CO sensors configured to generate fifth, sixth, seventh, and eighth signals, respectively, indicative of first, second, third, and fourth CO levels, respectively, at the first, second, third, and fourth locations, respectively, in the boiler system;

first, second, third, and fourth slag detection sensors disposed substantially at the first, second, third, and fourth locations, respectively, in the boiler system, the first, second, third, and fourth slag detection sensors configured to generate ninth, tenth, eleventh, and twelfth signals, respectively, indicative of first, second, third, and fourth slag thicknesses, respectively, at the first, second, third, and fourth locations, respectively, in the boiler system; and a controller operably coupled to the first, second, third, and fourth temperature sensors and to the first, second, third, and fourth CO sensors and to the first, second, third, and fourth slag detection sensors, the controller configured to determine the first second, third, and fourth temperature levels at the first, second, third, and fourth locations, respectively, based on the first, second, third, and fourth signals, respectively;

the controller further configured to determine the first, second, third, and fourth CO levels at the first, second, third and fourth locations, respectively, based on the fifth, sixth, seventh, and eighth signals, respectively;

the controller further configured to determine the first, second, third, and fourth slag thickness levels at the first, second, third, and fourth locations, respectively, based on the ninth, tenth, eleventh, and twelfth signals, respectively;

the controller further configured to determine the first and second locations have the first and second slag thickness levels, respectively, greater than a threshold slag thickness level, and the first and second temperature levels, respectively, less than or equal to a threshold temperature level, and the first and second CO levels, respectively, greater than a threshold CO level;

the controller further configured to determine the first and second burners in the boiler system are contributing to the first and second locations having the first and slag thickness levels greater than the threshold slag thickness level, and the first and second temperature levels less than or equal to the threshold temperature level, and the first and second CO levels greater than the threshold CO level, utilizing a mass-flow based influence factor map;

the controller further configured to increase an A/F ratio of at least one burner of the first and second burners to decrease the rate of slag formation at the first and second locations.

19. A method for decreasing a rate of slag formation in predetermined locations within a boiler system, the boiler system having first, second, third, and fourth burners disposed therein, the method comprising:

receiving first, second, third and fourth signals from first, second, third, and fourth temperature sensors, respectively, disposed substantially at first, second, third, and fourth locations, respectively, in the boiler system between the first, second, third, and fourth burners, respectively, and an exit plane of the boiler system;

determining first, second, third, and fourth temperature levels at the first, second, third, and fourth locations, respectively, in the boiler system based on the first, second, third, and fourth signals, respectively;

receiving fifth, sixth, seventh, and eighth signals from first, second, third, and fourth CO sensors, respectively, disposed substantially at the first, second, third, and fourth locations, respectively, in the boiler system;

determining first, second, third, and fourth CO levels at the first, second, third, and fourth locations, respectively, based on the fifth, sixth, seventh, and eighth signals, respectively;

receiving ninth, tenth, eleventh, and twelfth signals from first second, third, and fourth slag detection sensors, respectively, disposed substantially at the first, second, third, and fourth locations, respectively, in the boiler system;

determining first, second, third, and fourth slag thickness levels at the first, second, third, and fourth locations, respectively, based on the ninth, tenth, eleventh, and twelfth signals, respectively;

determining the first and second locations have the first and second slag thickness levels, respectively, greater than a threshold slag thickness level, and the first and second temperature levels, respectively, less than or equal to a threshold temperature level, and the first and second CO levels, respectively, less than or equal to a threshold CO level;

determining the first and second burners in the boiler system are contributing to the first and second locations having the first and second slag thickness levels greater than the threshold slag thickness level, and the first and second temperature levels less than or equal to the threshold temperature level, and the first and second CO levels less than or equal to the threshold CO level, utilizing a mass-flow based influence factor map; and decreasing at least one of an air-fuel mass flow to the least one burner of the first and second burners and a fuel mass flow to the at least one burner of the first and second burners, to decrease the rate of slag formation at the first and second locations.

20. The method of claim 19, wherein determining the first and second burners, comprises:

accessing the mass-flow based influence factor map indicating an air-fuel mass flow or a percentage mass flow at each location of the first and second locations from each burner of the first, second, third and fourth burners; and identifying burners from the first, second, third, and fourth burners having an air-fuel mass flow or a percentage mass flow greater than a predetermined value, to determine the first and second burners.

21. The method of claim 19, further comprising:

determining the third and fourth locations that have the third and fourth slag thickness levels, respectively, less than or equal to the threshold slag thickness level, or the third and fourth temperature levels greater than the threshold temperature level, or the third and fourth CO levels greater than the threshold CO level;

determining the third and fourth burners in the boiler system are contributing to the third and fourth locations having the third and fourth slag thickness levels less than or equal to the threshold slag thickness level, or the third and fourth temperature levels greater than the threshold temperature level, or the third and fourth CO levels greater than the threshold CO level, utilizing a mass-flow based influence factor map; and increasing at least one of an air-fuel mass flow to the least one burner of the third and fourth burners, and a fuel mass flow to the least one burner of the third and fourth burners.

22. A control system for decreasing a rate of slag formation in predetermined locations within a boiler system, the boiler system having a first, second, third, and fourth burners disposed therein, the control system comprising:

first, second, third, and fourth temperature sensors disposed substantially at first, second, third, and fourth locations, respectively, in the boiler system, between the first, second, third, and fourth burners, respectively, and an exit plane of the boiler system the first, second, third, and fourth temperature sensors configured to generate first second, third, and fourth signals, respectively, indicative of first, second, third, and fourth temperature levels, respectively, at the first, second, third, and fourth locations, respectively, in the boiler system;

first, second, third, and fourth CO sensors disposed substantially at the first, second, third, and fourth locations, respectively, in the boiler system, the first, second, third, and fourth CO sensors configured to generate fifth, sixth, seventh, and eighth signals, respectively, indicative of first, second, third, and fourth CO levels, respectively, at the first, second, third, and fourth locations, respectively, in the boiler system;

first, second, third, and fourth slag detection sensors disposed substantially at the first, second, third, and fourth locations, respectively, in the boiler system, the first, second, third, and fourth slag detection sensors configured to generate ninth, tenth, eleventh, and twelfth signals, respectively, indicative of first, second, third, and fourth slag thicknesses, respectively, at the first, second, third, and fourth locations, respectively, in the boiler system; and a controller operably coupled to the first, second, third, and fourth temperature sensors and to the first, second, third, and fourth CO sensors and to the first, second, third, and fourth slag detection sensors, the controller configured to determine the first, second, third, and fourth temperature levels at the first, second, third, and fourth locations, respectively, based on the first, second, third, and fourth signals, respectively;

the controller further configured to determine the first, second, third, and fourth CO levels at the first, second, third, and fourth locations, respectively, based on the fifth, sixth, seventh, and eighth signals, respectively;

the controller further configured to determine the first, second, third, and fourth slag thickness levels at the first, second, third, and fourth locations, respectively, based on the ninth, tenth, eleventh, and twelfth signals, respectively;

the controller further configured to determine the first and second locations have the first and second slag thickness levels, respectively, greater than a threshold slag thickness level, and the first and second temperature levels, respectively, less than or equal to a threshold temperature level, and the first and second CO levels, respectively, less than or equal to a threshold CO level;

the controller further configured to determine the first and second burners in the boiler system are contributing to the first and second locations having the first and second slag thickness levels greater than the threshold slag thickness level, and the first and second temperature levels less than or equal to the threshold temperature level, and the first and second CO levels less than or equal to the threshold CO level, utilizing a mass-flow based influence factor map;

the controller further configured to decrease at least one of an air-fuel mass flow to the least one burner of the first and second burners, and a fuel mass flow to the least one burner of the first and second burners, to decrease the rate of slag formation at the first and second locations.

23. A method for decreasing a rate of slag formation in predetermined locations within a boiler system, the boiler system having first, second, third, and fourth burners disposed therein, the method comprising:

receiving first, second, third, and fourth signals from first, second, third, and fourth slag detection sensors, respectively, disposed substantially at first, second, third and fourth locations, respectively, in the boiler system between the first, second, third, and fourth burners, respectively, and an exit plane of the boiler system;

determining first, second, third, and fourth slag thickness levels at the first, second, third, and fourth locations, respectively, in the boiler system based on the first, second, third, and fourth signals, respectively;

determining the first and second locations in the boiler system have the first and second slag thickness levels, respectively, greater than a threshold slag thickness level;

determining the first and second burners in the boiler system are contributing to the first and second locations having the first and second slag thickness levels greater than the threshold slag thickness level, utilizing a mass-flow based influence factor map; and delivering a slag reducing compound to the first and second burners for decreasing the rate of slag formation at the first and second locations.

24. A control system for decreasing a rate of slag formation in predetermined locations within a boiler system, the boiler system having first, second, third, and fourth burners disposed therein, the control system comprising:

first, second, third, and fourth slag detection sensors disposed substantially at first, second, third, and fourth locations, respectively, in the boiler system between the first, second, third, and fourth burners, respectively, and an exit plane of the boiler system the first, second, third, and fourth slag detection sensors configured to generate first, second, third and fourth signals indicative of first, second, third, and fourth slag thicknesses, respectively, at the first, second, third, and fourth locations in the boiler system; and a controller operably coupled to the first, second, third, and fourth slag detection sensors, the controller further configured to determine the first, second, third, and fourth slag thickness levels at the first, second, third, and fourth locations, respectively, based on the first, second, third, and fourth signals, respectively;

the controller further configured to determine the first and second locations in the boiler system that have the first and second slag thickness levels, respectively, greater than a threshold slag thickness level;

the controller further configured to determine the first and second burners in the boiler system are contributing to the first and second locations having the first and second slag thickness levels greater than the threshold slag thickness level, utilizing a mass-flow based influence factor map;

the controller further configured to induce a first device to deliver a slag reducing compound to the first and second burners for decreasing the rate of slag formation at the first and second locations.

* * * * *